US011293672B2

(12) United States Patent
Suzuki et al.

(10) Patent No.: US 11,293,672 B2
(45) **Date of Patent: *Apr. 5, 2022**

(54) HEAT-PUMP USING APPARATUS

(71) Applicant: Mitsubishi Electric Corporation, Tokyo (JP)

(72) Inventors: Yasuhiro Suzuki, Tokyo (JP); Hirokazu Minamisako, Tokyo (JP); Kazutaka Suzuki, Tokyo (JP); Takafumi Mito, Tokyo (JP); Taro Hattori, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 115 days.

This patent is subject to a terminal disclaimer.

(21) Appl. No.: 16/494,883

(22) PCT Filed: Jun. 19, 2017

(86) PCT No.: PCT/JP2017/022499

§ 371 (c)(1),
(2) Date: Sep. 17, 2019

(87) PCT Pub. No.: WO2018/235125

PCT Pub. Date: Dec. 27, 2018

(65) Prior Publication Data

US 2020/0109881 A1 Apr. 9, 2020

(51) Int. Cl.
*F25B 13/00* (2006.01)
*F25B 49/02* (2006.01)
(Continued)

(52) U.S. Cl.
CPC ..... *F25B 13/00* (2013.01); *F25B 49/02* (2013.01); *F24F 11/36* (2018.01); *F25B 1/00* (2013.01);
(Continued)

(58) Field of Classification Search
CPC .. F25B 13/00; F25B 49/02; F25B 1/00; F25B 2313/006; F25B 2313/0231;
(Continued)

(56) References Cited

U.S. PATENT DOCUMENTS

2005/0132729 A1 6/2005 Manole
2014/0196483 A1 7/2014 Okazaki et al.
2018/0142931 A1 5/2018 Takagi

FOREIGN PATENT DOCUMENTS

CN 203837315 U 9/2014
EP 2 759 787 A1 7/2014
(Continued)

OTHER PUBLICATIONS

Morishita et al., Refrigeration and Air Conditioning Device and . . . System, Jun. 20, 2013, JP2013122364A, Whole Document (Year: 2013).*
(Continued)

*Primary Examiner* — Larry L Furdge
(74) *Attorney, Agent, or Firm* — Posz Law Group, PLC

(57) ABSTRACT

A heat-pump using apparatus includes a refrigerant circuit and a heat medium circuit. The refrigerant circuit is capable of executing a heating operation and a cooling operation. A first expansion device is provided downstream of a reservoir, and a second expansion device is provided upstream of the reservoir, in the flow of refrigerant in the heating operation. A main circuit of the heat medium circuit includes a branching part and a joining part. An overpressure protection device is connected to a connection part which is located between a load-side heat exchanger and one of the branching part and the joining part or at the load-side heat exchanger. A refrigerant leakage detecting device is connected to the other of the branching part and the joining part, or between
(Continued)

the other of the branching part and the joining part and the connection part, or to the connection part.

14 Claims, 7 Drawing Sheets

(51) Int. Cl.
*F24F 11/36* (2018.01)
*F25B 1/00* (2006.01)

(52) U.S. Cl.
CPC . *F25B 2313/006* (2013.01); *F25B 2313/0231* (2013.01); *F25B 2313/02732* (2013.01); *F25B 2500/222* (2013.01); *F25B 2600/2513* (2013.01)

(58) Field of Classification Search
CPC ..... F25B 2313/02732; F25B 2500/222; F25B 2600/2513; F25B 2313/003; F25B 2600/0251; F25B 49/005; F24F 11/36; F24D 3/08
See application file for complete search history.

(56) References Cited

FOREIGN PATENT DOCUMENTS

| | | | | |
|---|---|---|---|---|
| JP | 2002061996 | A | * | 2/2002 |
| JP | 2002228281 | A | * | 8/2002 |
| JP | 2009-257756 | A | | 11/2009 |
| JP | 2013122364 | A | * | 6/2013 |
| JP | 2013-167398 | A | | 8/2013 |
| JP | 2013167398 | A | * | 8/2013 |
| JP | 2015-209979 | A | | 11/2015 |
| JP | 2017-020776 | A | | 1/2017 |
| WO | 2013/038577 | A1 | | 3/2013 |

OTHER PUBLICATIONS

Aoyagi et al., Outdoor Unit and Heat Pump Cycle Device, Aug. 29, 2013, JP2013167398A, Whole Document (Year: 2013).*
Miya, Air Conditioner, Aug. 14, 2002, JP2002228281A., Whole Document (Year: 2002).*
Kaeriyama et al., Air Conditioner, Feb. 28, 2002, JP2002061996A, Whole Document (Year: 2002).*
International Search Report of the International Searching Authority dated Sep. 5, 2017 for the corresponding International application No. PCT/JP2017/022499 (and English translation).
Extended European Search Report dated May 10, 2019 issued in corresponding EP patent application No. 17914856.4.
Office Action dated Jul. 7, 2020 issued in corresponding JP patent application No. 2019-524716 (and English translation).
Chinese Office Action dated Dec. 21, 2020, issued in corresponding CN Patent Application No. 201780090974.5 (and English Machine Translation).
Japanese Office Action dated Feb. 2, 2021, issued in corresponding JP Patent Application No. 2019-524716 (and English Machine Translation).

* cited by examiner

HEAT-PUMP USING APPARATUS

CROSS REFERENCE TO RELATED APPLICATION

This application is a U.S. national stage application of PCT/JP2017/022499 filed on Jun. 19, 2017, the contents of which are incorporated herein by reference.

TECHNICAL FIELD

The present invention relates to a heat-pump using apparatus including a refrigerant circuit and a heat medium circuit.

BACKGROUND ART

Patent Literature 1 describes an outdoor unit of a heat-pump cycle apparatus using flammable refrigerant. The outdoor unit includes a refrigerant circuit in which a compressor, an air heat exchanger, an expansion device and a water heat exchanger are connected by pipes, and a pressure relief valve which prevents an excessive increase in hydraulic pressure in a water circuit for supplying water heated by the water heat exchanger. Thereby, even if a partition wall which isolates the refrigerant circuit and the water circuit from each other in the water heat exchanger is broken, and the flammable refrigerant thus enters the water circuit, the flammable refrigerant can be discharged to the outdoors via the pressure relief valve.

CITATION LIST

Patent Literature

Patent Literature 1: Japanese Unexamined Patent Application Publication No. 2013-167398

SUMMARY OF INVENTION

Technical Problem

In a heat-pump using apparatus such as a heat-pump cycle apparatus, in general, a pressure relief valve of a water circuit is provided in an indoor unit. In the heat-pump using apparatus, there are various combinations of outdoor and indoor units. For example, in a given case, an outdoor unit and an indoor unit manufactured by the same manufacturer are combined together, and in another case, an outdoor unit and an indoor unit manufactured by different manufacturers are combined. Therefore, the outdoor unit described in Patent Literature 1 may be combined with an indoor unit equipped with a pressure relief valve.

However, in the above case, if refrigerant leaks into the water circuit, refrigerant which mixes with water in the water circuit may be discharged not only from a pressure relief valve provided in the outdoor unit, but from a pressure relief valve disposed in the indoor unit. Therefore, there is a risk that the refrigerant will leak from the water circuit into a room.

The present invention aims to provide a heat-pump using apparatus which can prevent leaking refrigerant from entering a room.

Solution to Problem

A heat-pump using apparatus according to an embodiment of the present invention includes a refrigerant circuit which includes a compressor, a refrigerant flow switching device, a heat-source-side heat exchanger, a first expansion device, a reservoir, a second expansion device, and a load-side heat exchanger, and which circulates refrigerant, and a heat medium circuit which causes a heat medium to flow via the load-side heat exchanger. The state of the refrigerant flow switching device is switched between a first state and a second state. When the state of the refrigerant flow switching device is switched to the first state, the refrigerant circuit can perform a first operation in which the load-side heat exchanger functions as a condenser. When the state of the refrigerant flow switching device is switched to the second state, the refrigerant circuit can perform a second operation in which the load-side heat exchanger functions as an evaporator. The first expansion device is provided downstream of the reservoir and upstream of the heat-source-side heat exchanger in the flow of the refrigerant in the first operation. The second expansion device is provided downstream of the load-side heat exchanger and upstream of the reservoir in the flow of the refrigerant in the first operation. The heat medium circuit includes a main circuit extending via the load-side heat exchanger. The main circuit includes a branching part which is located at a downstream end of the main circuit, and connected to those portions of a plurality of branch circuits which branch from the main circuit, and a joining part which is located at an upstream end of the main circuit, and connected to those portions of the plurality of branch circuits which join the main circuit. The main circuit is connected to an overpressure protection device and a refrigerant leakage detecting device. The overpressure protection device is connected to a connection part which is located between the load-side heat exchanger and one of the branching part and the joining part in the main circuit or at the load-side heat exchanger in the main circuit. The refrigerant leakage detecting device is connected to the other of the branching part and the joining part in the main circuit, or between the other one of the branching part and the joining part and the connection part in the main circuit, or the connection part in the main circuit. When leakage of the refrigerant into the heat medium circuit is detected, the refrigerant flow switching device is set in the second state, the first expansion device is set in an opened state, the second expansion device is set in a closed state, and the compressor is operated.

Advantageous Effects of Invention

According to the present invention, in the case where refrigerant leaks into the heat medium circuit, the refrigerant leakage detecting device can early detect the leakage of the refrigerant into the heat medium circuit. When the leakage of the refrigerant into the heat medium circuit is detected, the refrigerant in the refrigerant circuit is retrieved. Since the leakage of the refrigerant is early detected, the retrieval of the refrigerant is also early carried out. It is therefore possible to prevent or reduce leakage of the refrigerant into an indoor space.

DESCRIPTION OF EMBODIMENTS

Embodiment 1

Figure 1:
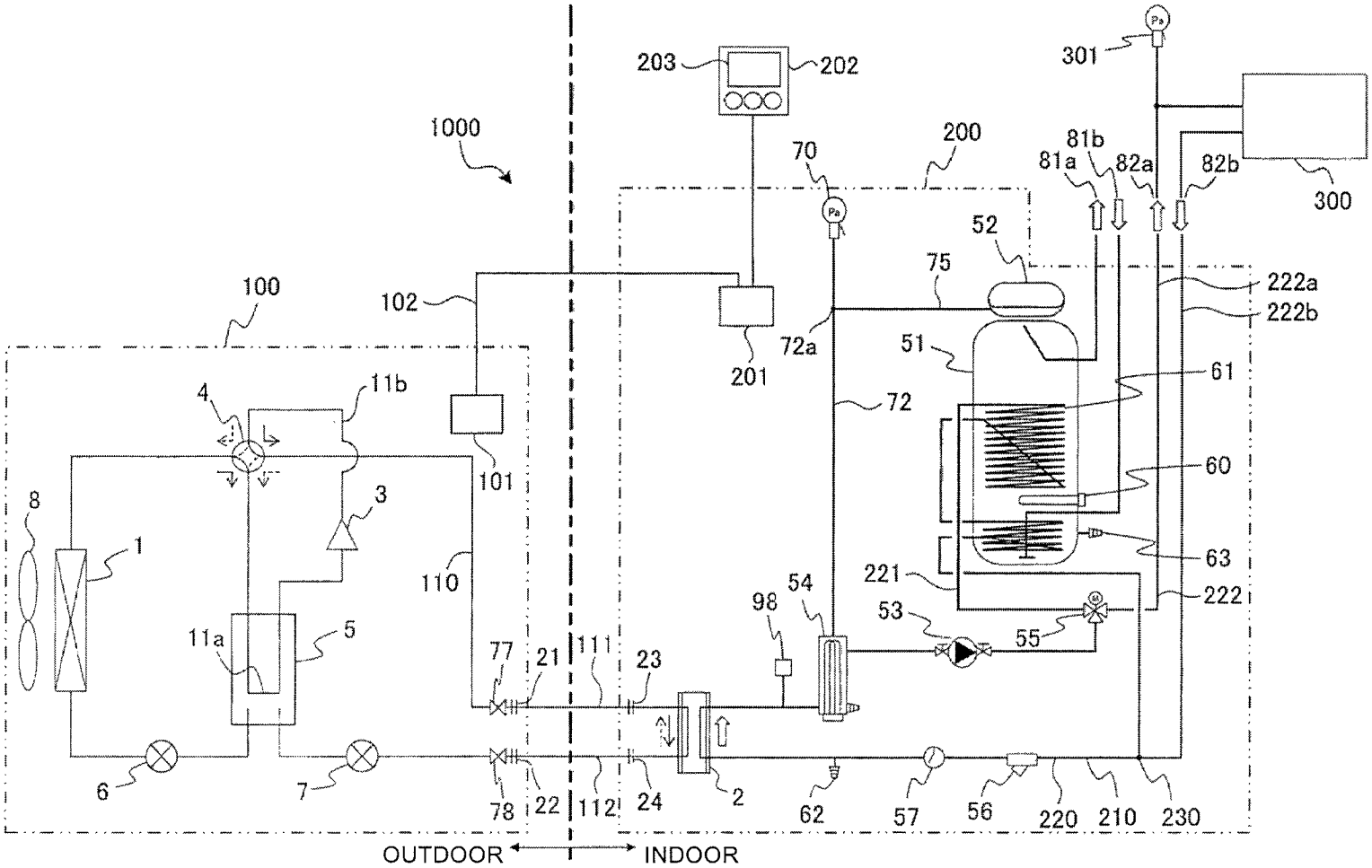
FIG. 1 is a circuit diagram illustrating a schematic configuration of a heat-pump using apparatus according to embodiment 1 of the present invention.

A heat-pump using apparatus according to embodiment 1 of the present invention will be described. FIG. 1 is a circuit diagram illustrating a schematic configuration of the heat-pump using apparatus according to embodiment 1. In embodiment 1, a heat-pump hot-water supply heating apparatus 1000 is provided as an example of the heat-pump using apparatus. In figures including FIG. 1 which are to be referred to below, the relationships in size, shape, etc. between structural components may be different from actual ones.

As illustrated in FIG. 1, the heat-pump hot-water supply heating apparatus 1000 includes a refrigerant circuit 110 in which refrigerant is circulated and a water circuit 210 in which water is made to flow. The heat-pump hot-water supply heating apparatus 1000 further includes an outdoor unit 100 installed outside an indoor space (outdoors, for example) and an indoor unit 200 installed in the indoor space. The indoor unit 200 is installed in, for example, a kitchen, a bathroom, a laundry room, or a storage space such as a closet in a building.

In the refrigerant circuit 110, a compressor 3, a refrigerant flow switching device 4, a heat-source-side heat exchanger 1, a first expansion device 6, an intermediate-pressure receiver 5, a second expansion device 7 and a load-side heat exchanger 2 are successively connected by refrigerant pipes. The refrigerant circuit 110 is capable of performing a heating and hot-water supplying operation to heat water flowing in the water circuit 210 (which will be hereinafter occasionally referred to as "normal operation" or "first operation") and a defrosting operation to defrost the heat-source-side heat exchanger 1 (which will be hereinafter occasionally referred to as "second operation"). In the defrosting operation, refrigerant flows in the opposite direction to the flow direction of the refrigerant in the heating and hot-water supplying operation. The refrigerant circuit 110 may also be capable of performing a cooling operation to cool the water flowing in the water circuit 210. In the cooling operation, the refrigerant flows in the same direction as in the defrosting operation.

The compressor 3 is a fluid machine which compresses low-pressure refrigerant sucked therein, and discharges the refrigerant as high-pressure refrigerant. In this embodiment, the compressor 3 includes, for example, an inverter device which arbitrarily changes a driving frequency.

Figure 2:
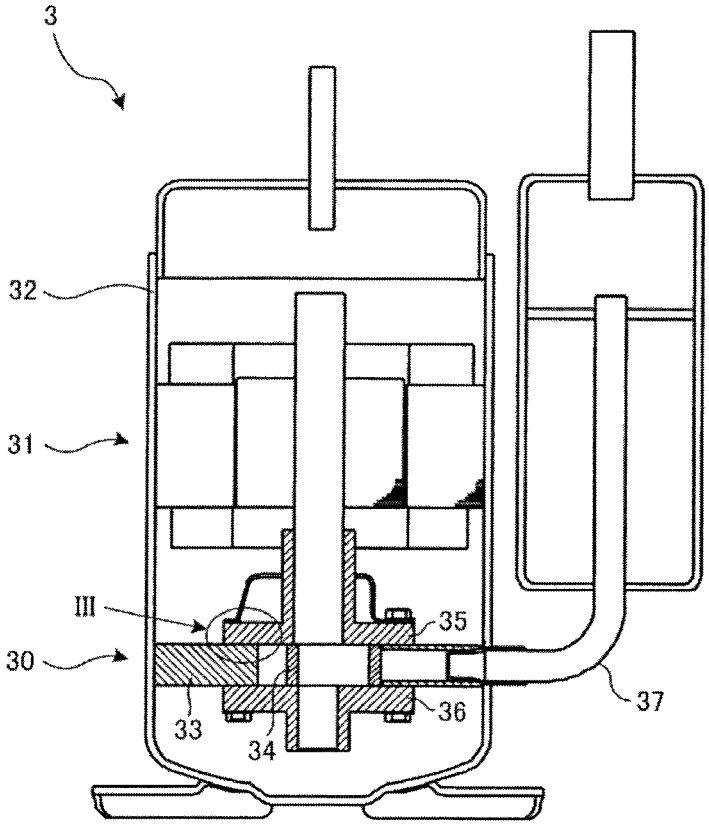
FIG. 2 is a sectional view illustrating a schematic configuration of a compressor 3 of the heat-pump using apparatus according to embodiment 1 of the present invention.
Figure 3:
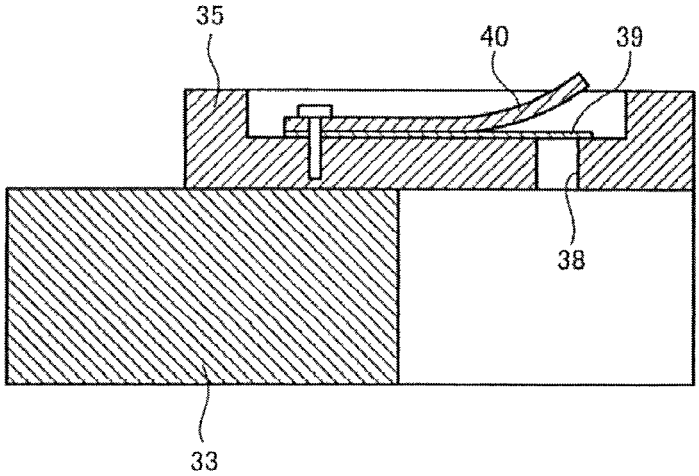
FIG. 3 is an enlarged view of a section III as illustrated in FIG. 2.

An example of the configuration of the compressor 3 will be described with reference to the drawings. FIG. 2 is a sectional view illustrating a schematic configuration of the compressor 3 of the heat-pump using apparatus according to embodiment 1. FIG. 3 is an enlarged view of a section III as illustrated in FIG. 2. FIGS. 2 and 3 illustrate a sealed and high-pressure shell type of rolling-piston rotary compressor as the compressor 3. As illustrated in FIGS. 2 and 3, the compressor 3 includes a compression mechanism unit 30 which sucks and compresses refrigerant, an electric motor unit 31 which drives the compression mechanism unit 30, and a sealed reservoir 32 which stores the compression mechanism unit 30 and the electric motor unit 31. The compression mechanism unit 30 is provided at a lower portion of the interior of the sealed reservoir 32. The electric motor unit 31 is provided above the compression mechanism unit 30 in the sealed reservoir 32. The inner space of the sealed reservoir 32 is filled with the high-pressure refrigerant compressed by the compression mechanism unit 30.

The compression mechanism unit 30 includes a cylinder 33, a rolling piston 34, and a vane (not illustrated). The rolling piston 34 is provided in the cylinder 33, and is rotated along an inner circumferential surface of the cylinder 33 by a rotational driving force of the electric motor unit 31 which is transmitted via a main shaft. The vane is formed to partition the space between the inner circumferential surface of the cylinder 33 and the outer circumferential surface of the rolling piston 34 into a suction compartment and a compression compartment. Upper ends of the suction compartment and the compression compartment are closed by an upper end plate 35, which also serves as a bearing. Lower ends of the suction compartment and the compression compartment are closed by a lower end plate 36, which also serves as a bearing. The suction compartment sucks the low-pressure refrigerant via a suction pipe 37. The upper end plate 35 has a discharge hole 38 through which high-pressure refrigerant compressed in the compression compartment is discharged into the space in the sealed reservoir 32. On an outlet side of the discharge hole 38, there are provided a discharge valve 39 having a reed valve structure and a valve stopper 40 which restricts flexure of the discharge valve 39. The discharge valve 39 functions as a check valve which prevents the high-pressure refrigerant in the sealed reservoir 32 from flowing back into the compression compartment during a compression process. The discharge valve 39 also functions as a check valve when the compressor 3 is in a stopped state.

Referring back to FIG. 1, the refrigerant flow switching device 4 switches the flow direction of the refrigerant in the refrigerant circuit 110 between that in the normal operation and that in the defrosting operation. A four-way valve or a combination of a plurality of two-way valves or three-way valves may be used as the refrigerant flow switching device 4. The refrigerant flow switching device 4 and the compressor 3 are connected by a suction pipe 11*a* and a discharge pipe 11*b*. To be more specific, the suction pipe 11*a* connects the refrigerant flow switching device 4 and a suction port of the compressor 3. In the suction pipe 11*a*, low-pressure refrigerant flows from the refrigerant flow switching device 4 toward the compressor 3 through the suction pipe 11*a* regardless of the state of the refrigerant flow switching device 4. The discharge pipe 11*b* connects the refrigerant flow switching device 4 and a discharge port of the compressor 3. In the discharge pipe 11*b*, high-pressure refrigerant flows from the compressor 3 toward the refrigerant flow switching device 4 regardless of the state of the refrigerant flow switching device 4. It should be noted that in the case where the refrigerant circuit 110 is designed specifically for the heating operation or the cooling operation, the refrigerant flow switching device 4 can be omitted.

The load-side heat exchanger 2 is a water-refrigerant heat exchanger which causes heat exchange to be carried out between refrigerant flowing in the refrigerant circuit 110 and water flowing in the water circuit 210. For example, a plate heat exchanger is used as the load-side heat exchanger 2. The load-side heat exchanger 2 includes a refrigerant passage which allows refrigerant to flow therethrough, as part of the refrigerant circuit 110, a water passage which allows water to flow therethrough as part of the water circuit 210, and a thin-plate partition wall which isolates the refrigerant passage and the water passage from each other. In a normal operation, the load-side heat exchanger 2 functions as a condenser, that is, a heat-transfer device, which transfers condensation heat of refrigerant to water. In the defrosting operation or the cooling operation, the load-side heat exchanger 2 functions as an evaporator, that is, a heat absorber, which receives, as evaporation heat of refrigerant, heat from water.

Each of the first expansion device 6 and the second expansion device 7 is a device which adjusts the flow rate of refrigerant to adjust the pressure of the refrigerant. The first expansion device 6 is provided downstream of the intermediate-pressure receiver 5 and upstream of the heat-source-side heat exchanger 1 in the flow of the refrigerant in the normal operation. The second expansion device 7 is provided downstream of the load-side heat exchanger 2 and upstream of the intermediate-pressure receiver 5 in the flow of the refrigerant in the normal operation. An electronic expansion valve, the opening degree of which can be changed continuously or stepwise by control by a controller 101 to be descried later, is used as each of the first expansion device 6 and the second expansion device 7. A temperature-sensitive expansion valve, such as a temperature-sensitive expansion valve integrated with a solenoid valve, may be used as each of the first expansion device 6 and the second expansion device 7.

The intermediate-pressure receiver 5 is a reservoir which is located between the first expansion device 6 and the second expansion device 7 in the refrigerant circuit 110 to store surplus refrigerant. Part of the suction pipe 11*a* extends through the intermediate-pressure receiver 5. In the intermediate-pressure receiver 5, refrigerant flowing through the suction pipe 11*a* and refrigerant in the intermediate-pressure receiver 5 exchange heat with each other. Therefore, the intermediate-pressure receiver 5 also functions as an internal heat exchanger in the refrigerant circuit 110.

The heat-source-side heat exchanger 1 is an air-refrigerant heat exchanger which causes heat exchange to be carried out between the refrigerant flowing through the refrigerant circuit 110 and outdoor air sent by an outdoor fan 8. In the normal operation, the heat-source-side heat exchanger 1 functions as an evaporator, that is, a heat absorber, which receives, as the evaporation heat of the refrigerant, heat from outdoor air. In the defrosting operation or the cooling operation, the heat-source-side heat exchanger 1 functions as a condenser, that is, a heat-transfer device, which transfers the condensation heat of the refrigerant to the outdoor air.

The compressor 3, the refrigerant flow switching device 4, the heat-source-side heat exchanger 1, the first expansion device 6, the intermediate-pressure receiver 5, and the second expansion device 7 are provided in the outdoor unit 100. The load-side heat exchanger 2 is provided in the indoor unit 200. That is, the refrigerant circuit 110 is provided to extend over the outdoor unit 100 and indoor unit 200. Part of the refrigerant circuit 110 is located in the outdoor unit 100, and the other part of the refrigerant circuit 110 is located in the indoor unit 200. The outdoor unit 100 and the indoor unit 200 are connected by two extension pipes 111 and 112 each forming part of the refrigerant circuit 110. One of the ends of the extension pipe 111 is connected to the outdoor unit 100 by a joint 21, and the other is connected to the indoor unit 200 by a joint 23. One of the ends of the extension pipe 112 is connected to the outdoor unit 100 by a joint 22, and the other is connected to the indoor unit 200 by a joint 24. As each of the joints 21, 22, 23, and 24, for example, a flare joint is used.

As a first blocking device, an opening and closing valve 77 is provided upstream of the load-side heat exchanger 2 in the flow of the refrigerant in the normal operation. In the flow of the refrigerant in the normal operation, the opening and closing valve 77 is located downstream of the heat-source-side heat exchanger 1 and upstream of the load-side heat exchanger 2 in refrigerant circuit 110. That is, in the refrigerant circuit 110, the opening and closing valve 77 is located between the load-side heat exchanger 2 and the refrigerant flow switching device 4, at part of the suction pipe 11*a* which is located between the refrigerant flow switching device 4 and the compressor 3, at part of the discharge pipe 11*b* which is located between which is located the refrigerant flow switching device 4 and the compressor 3, between the refrigerant flow switching device 4 and the heat-source-side heat exchanger 1, or at the compressor 3. In the case where the refrigerant flow switching device 4 is provided as in embodiment 1, it is preferable that the opening and closing valve 77 be located downstream of the refrigerant flow switching device 4 and upstream of the load-side heat exchanger 2 in the refrigerant circuit 110 in the flow of the refrigerant in the normal operation. The opening and closing valve 77 is provided in the outdoor unit 100. As the opening and closing valve 77, an automatic valve, such as a solenoid valve, a flow control valve, or an electronic expansion valve, which is to be controlled by the controller 101 to be described later, is used. The opening and closing valve 77 is in an opened state during the operation of the refrigerant circuit 110, which includes the normal operation and the defrosting operation. When the opening and closing valve 77 is made to be in a closed state by the control by the controller 101, the opening and closing valve 77 blocks the flow of the refrigerant.

Further, as a second blocking device, an opening and closing valve 78 is disposed downstream of the load-side heat exchanger 2 in the flow of the refrigerant in the normal operation. The opening and closing valve 78 is provided downstream of the load-side heat exchanger 2 and upstream of the second expansion device 7 in the refrigerant circuit 110 in the flow of the refrigerant in the normal operation. The opening and closing valve 78 is stored in the outdoor unit 100. An automatic valve, such as a solenoid valve, a flow control valve, or an electronic expansion valve, which is to be controlled by the controller 101 to be described later, is used as the opening and closing valve 78. The opening and closing valve 78 is in the opened state during the operation of the refrigerant circuit 110, which includes the normal operation and the defrosting operation. When the opening and closing valve 78 is set in the closed state by the control by the controller 101, the opening and closing valve 78 blocks the flow of the refrigerant.

Each of the opening and closing valves 77 and 78 may be a manual valve to be opened/closed manually. There is a case where at a connecting part between the outdoor unit 100 and the extension pipe 111, an extension-pipe connecting valve is provided, the extension-pipe connecting valve being provided with a two-way valve whose state can be manually switched between an opened state and a closed state. One end of the extension-pipe connecting valve is connected to a refrigerant pipe in the outdoor unit 100, and at the other end of the extension-pipe connecting valve, the joint 21 is provided. In the case where such an extension-pipe connecting valve is provided, the extension-pipe connecting valve may be used as the opening and closing valve 77.

Also, there is a case where at connection part between the outdoor unit 100 and the extension pipe 112, an extension-pipe connecting valve is provided, the extension-pipe connecting valve being provided with a three-way valve whose state can be manually switched between an opened state and a closed state. One end of the extension-pipe connecting valve is connected to a refrigerant pipe in the outdoor unit 100, at another end of the extension-pipe connecting valve, the joint 22 is provided, and at the remaining end of the extension-pipe connecting valve, a service port is provided, the service port being applied to vacuuming to be performed before the refrigerant circuit 110 is filled with refrigerant. In the case where such an extension-pipe connection part is provided, the extension-pipe connecting valve may be used as the opening and closing valve 78.

For example, a slightly flammable refrigerant such as R1234yf or R1234ze(E) or a highly flammable refrigerant such as R290 or R1270 is used as the refrigerant circulating in the refrigerant circuit 110. Each of these refrigerants may be used as a single refrigerant, or two or more of them may be mixed and used as a mixed refrigerant. Hereinafter, there is a case where a refrigerant having flammability of at least a slightly flammable level (at least 2L under ASHRAE34 classification, for example) will be referred to as "flammable refrigerant." Furthermore, an inflammable refrigerant having inflammability (1 under ASHRAE34 classification, for example) such as R4070 or R410A may be used as refrigerant to be circulated in the refrigerant circuit 110. These refrigerants have a higher density than air under atmospheric pressure (when the temperature is room temperature (25 degrees Celsius), for example). Furthermore, refrigerant having toxicity, such as R717 (ammonia), may be used as the refrigerant to be circulated in the refrigerant circuit 110.

Further, the outdoor unit 100 includes the controller 101 which controls, as a main control, the operation of the refrigerant circuit 110 which includes the compressor 3, the refrigerant flow switching device 4, the opening and closing valves 77 and 78, the first expansion device 6, the second expansion device 7, the outdoor fan 8, etc. The controller 101 includes a microcomputer provided with a CPU, a ROM, a RAM, an I/O port, etc. The controller 101 is capable of communicating, via a control line 102, with a controller 201 and an operation unit 202, which will be described later.

An example of the operation of the refrigerant circuit 110 will be described. In FIG. 1, solid arrows indicate the flow direction of refrigerant in the refrigerant circuit 110 in the normal operation. In the normal operation, the refrigerant flow switching device 4 switches refrigerant passages as indicated by the solid arrows, and the refrigerant circuit 110 is configured such that high-temperature, high-pressure refrigerant flows into the load-side heat exchanger 2. There is a case where the state of the refrigerant flow switching device 4 in the normal operation will be referred to as a first state.

The high-temperature, high-pressure gas refrigerant discharged from the compressor 3 passes through the opening and closing valve 77 being in the opened state and the extension pipe 111, and flows into the refrigerant passage of the load-side heat exchanger 2. In the normal operation, the load-side heat exchanger 2 functions as a condenser. That is, the load-side heat exchanger 2 causes heat exchange to be carried out between refrigerant flowing through the refrigerant passage and water flowing through the water passage, and the condensation heat of the refrigerant is transferred to the water. Thereby, the refrigerant flowing through the refrigerant passage of the load-side heat exchanger 2 condenses and changes into high-pressure liquid refrigerant. Furthermore, the water flowing through the water passage of the load-side heat exchanger 2 is heated by the heat transferred from the refrigerant.

The high-pressure liquid refrigerant condensed at the load-side heat exchanger 2 flows into the second expansion device 7 via the extension pipe 112 and the opening and closing valve 78 being in the opened state, and is reduced in pressure to change into intermediate-pressure, two-phase refrigerant. It should be noted that intermediate pressure is a pressure which is lower than a high pressure in the refrigerant circuit 110, i.e., a discharge pressure of the compressor 3, and which is higher than a low pressure in the refrigerant circuit 110, i.e., a suction pressure of the compressor 3. The intermediate-pressure, two-phase refrigerant flows into the intermediate-pressure receiver 5, and is cooled through heat exchange with low-pressure gas refrigerant flowing through the suction pipe 11*a* to change into intermediate-pressure liquid refrigerant. The intermediate-pressure liquid refrigerant flows from the intermediate-pressure receiver 5, and then flows into the first expansion device 6, and is reduced in pressure to change into low-pressure, two-phase refrigerant.

The low-pressure, two-phase refrigerant reduced in pressure by the first expansion device 6 flows into the heat-source-side heat exchanger 1. In the normal operation, the heat-source-side heat exchanger 1 functions as an evaporator. To be more specific, in the heat-source-side heat exchanger 1, heat exchange is carried out between the refrigerant flowing therein and the outdoor air sent by the outdoor fan 8, whereby the evaporation heat of the refrigerant is received by the outdoor air. By virtue of this configuration, the low-pressure, two-phase refrigerant having flowed into the heat-source-side heat exchanger 1 evaporates and changes into low-pressure gas refrigerant. The low-pressure gas refrigerant flows into the suction pipe 11*a* via the refrigerant flow switching device 4. The low-pressure gas refrigerant having flowed into the suction pipe 11*a* is heated through heat exchange with the refrigerant in the intermediate-pressure receiver 5, and is sucked into the compressor 3. The refrigerant sucked into the compressor 3 is compressed and changes into high-temperature, high-pressure gas refrigerant. In the normal operation, the above cycle is continuously repeated.

It will be described by way of example what operation is performed during the defrosting operation. In FIG. 1, broken arrows indicate the flow direction of the refrigerant in the refrigerant circuit 110 in the defrosting operation. In the defrosting operation, the refrigerant flow switching device 4 switches the refrigerant passages as indicated by the broken arrows, whereby the refrigerant circuit 110 is configured such that the high-temperature, high-pressure refrigerant flows into the heat-source-side heat exchanger 1. The state of the refrigerant flow switching device 4 in the defrosting operation will occasionally be referred to as the second state.

The high-temperature, high-pressure gas refrigerant discharged from the compressor 3 flows into the heat-source-side heat exchanger 1 via the refrigerant flow switching device 4. In the defrosting operation, the heat-source-side heat exchanger 1 functions as a condenser. To be more specific, in the heat-source-side heat exchanger 1, the condensation heat of the refrigerant flowing therein is transferred to frost formed on a surface of the heat-source-side heat exchanger 1. By virtue of this configuration, the refrigerant flowing in the heat-source-side heat exchanger 1 condenses and changes into high-pressure liquid refrigerant. Further, the frost formed on the surface of the heat-source-side heat exchanger 1 is melted by the heat transferred from the refrigerant.

The high-pressure liquid refrigerant condensed by the heat-source-side heat exchanger 1 passes through the first expansion device 6, the intermediate-pressure receiver 5 and the second expansion device 7 to change into low-pressure, two-phase refrigerant. The low-pressure, two-phase refrigerant flows into the refrigerant passage of the load-side heat exchanger 2 through the opening and closing valve 78 being in the opened state and the extension pipe 112. In the defrosting operation, the load-side heat exchanger 2 functions as an evaporator. That is, in the load-side heat exchanger 2, heat exchange is performed between the refrigerant flowing through the refrigerant passage and the water flowing through the water passage, whereby heat is received from the water as the evaporation heat of the refrigerant. By virtue of this configuration, the refrigerant flowing in the refrigerant passage of the load-side heat exchanger 2 evaporates and changes into low-pressure gas refrigerant. The gas refrigerant passes through the extension pipe 111, the opening and closing valve 77 being in the opened state, and the refrigerant flow switching device 4, and is then sucked into the compressor 3. The refrigerant sucked into the compressor 3 is compressed and changes into high-temperature, high-pressure gas refrigerant. In the defrosting operation, the above cycle is continuously repeated.

The water circuit 210 will be described. The water circuit 210 of embodiment 1 is a closed circuit which circulates water. In FIG. 1, the flow directions of the water are indicated by outlined arrows. The water circuit 210 is provided mainly in the indoor unit 200. The water circuit 210 includes a main circuit 220, a branch circuit 221 forming a hot-water supply circuit, and a branch circuit 222 forming part of a heating circuit. The main circuit 220 forms part of the closed circuit. The branch circuits 221 and 222 are connected to the main circuit 220 as branches therefrom. The branch circuits 221 and 222 are disposed in parallel to each other. The branch circuit 221 forms together with the main circuit 220 a closed circuit. The branch circuit 222 forms together with the main circuit 220, a heating apparatus 300, etc., a closed circuit. The heating apparatus 300 is connected to the branch circuit 222. The heating apparatus 300 is provided in the indoor space, and is located separate from the indoor unit 200. As the heating apparatus 300, for example, a radiator or a floor-heating apparatus is used.

With respect to embodiment 1, although water is described as an example of a heat medium which flows in the water circuit 210, another liquid heat medium such as brine can be used as the heat medium.

In the main circuit 220, a strainer 56, a flow switch 57, the load-side heat exchanger 2, a booster heater 54, a pump 53, etc., are connected by water pipes. At intermediate part of the water pipes forming the main circuit 220, a drain outlet 62 is provided to drain water in the water circuit 210. A downstream end of the main circuit 220 is connected to an inflow port of a three-way valve 55 (an example of a branching part) including a single inflow port and two outflow ports. At the three-way valve 55, the branch circuits 221 and 222 branch off from the main circuit 220. An upstream end of the main circuit 220 is connected to a joining part 230. At the joining part 230, the branch circuits 221 and 222 join the main circuit 220. Part of the water circuit 210 which extends from the joining part 230 to the three-way valve 55 via the load-side heat exchanger 2, etc., forms the main circuit 220.

The pump 53 is a device which pressurizes the water in the water circuit 210 to circulate the water in the water circuit 210. The booster heater 54 is a device which further heats the water in the water circuit 210, for example, when the heating capacity of the outdoor unit 100 is insufficient. The three-way valve 55 is a device which changes the flow of the water in the water circuit 210. To be more specific, the three-way valve 55 switches the flow of the water in the main circuit 220 between circulation of the water in the branch circuit 221 and circulation of the water in the branch circuit 222. The strainer 56 is a device which removes scale in the water circuit 210. The flow switch 57 is a device which detects whether the flow rate of the water circulating in the water circuit 210 is higher than or equal to a certain rate. The flow switch 57 can be replaced by a flow-rate sensor.

The booster heater 54 is connected to a pressure relief valve 70 (an example of an overpressure protection device). That is, the booster heater 54 serves as connection part of the pressure relief valve 70, which is connected to the water circuit 210. There is a case where the connection part of the pressure relief valve 70 which is connected to the water circuit 210 will be hereinafter merely referred to as "connection part". The pressure relief valve 70 is a protection device which prevents an excessive increase in pressure in the water circuit 210 which accompanies a change in temperature of the water. The pressure relief valve 70 discharges the water to the outside of the water circuit 210 based on the pressure in the water circuit 210. If the inner pressure of the water circuit 210 increases to exceed a pressure control range of a later-described expansion tank 52, the pressure relief valve 70 is opened to discharge the water in the water circuit 210 to the outside of the water circuit 210 from the pressure relief valve 70. The pressure relief valve 70 is provided at the indoor unit 200 in order to effect pressure protection in the water circuit 210 in the indoor unit 200.

A housing of the booster heater 54 is connected to one of ends of a pipe 72 forming a water passage branching off from the main circuit 220. To the other end of the pipe 72, the pressure relief valve 70 is attached. That is, the pressure relief valve 70 is connected to the booster heater 54 by the pipe 72. In the main circuit 220, the temperature of water in the booster heater 54 is the highest. Therefore, the booster heater 54 is most suitable as the connection part to which the pressure relief valve 70 is connected. Further, in the case where the pressure relief valve 70 is connected to the branch circuits 221 and 222, at the branch circuits 221 and 222, respective pressure relief valves 70 need to be provided. By contrast, in embodiment 1, since the pressure relief valve 70 is connected to the main circuit 220, it suffices to provide a single pressure relief valve 70. The connection part of the pressure relief valve 70 connected to the main circuit 220 is located between the load-side heat exchanger 2 and one of the three-way valve 55 and the joining part 230 or at the load-side heat exchanger 2 in the main circuit 220.

At an intermediate part of the pipe 72, a branching part **72*a* is provided. The branching part 72*a* is connected to one of ends of a pipe 75. The other end of the pipe 75 is connected to the expansion tank 52. That is, the expansion tank 52 is connected 25 to the booster heater 54 by the pipes 75 and 72. The expansion tank 52 is a device which controls the change of the inner pressure of the water circuit 210, which accompanies the change of the temperature of the water, such that the change of the inner pressure of the water circuit 210** falls within a certain range.

The main circuit 220 includes a refrigerant leakage detecting device 98. The refrigerant leakage detecting device 98 is connected between the load-side heat exchanger 2 and the booster heater 54 (that is, the connection part) in the main circuit 220. The refrigerant leakage detecting device 98 is a device which detects leakage of refrigerant from the refrigerant circuit 110 into the water circuit 210. If refrigerant leaks from the refrigerant circuit 110 into the water circuit 210, the inner pressure of the water circuit 210 raises. Therefore, the refrigerant leakage detecting device 98 can detect the leakage of the refrigerant into the water circuit 210 based on the value of the inner pressure of the water circuit 210 or the variation of the inner pressure thereof which is made with the passage of time. As the refrigerant leakage detecting device 98, a pressure sensor or high-pressure switch which detects the inner pressure of the water circuit 210 is used. The high-pressure switch may adopt an electric system or a mechanical system using a diaphragm. The refrigerant leakage detecting device 98 outputs a detection signal to the controller 201.

The branch circuit 221 forming the hot-water supply circuit is provided in the indoor unit 200. An upstream end of the branch circuit 221 is connected to one of the outflow ports of the three-way valve 55. A downstream end of the branch circuit 221 is connected to the joining part 230. The branch circuit 221 includes a coil 61. The coil 61 is located in a hot-water storage tank 51 which stores water. The coil 61 is a heating unit which heats the water in the hot-water storage tank 51 through heat exchange with hot water circulating in the branch circuit 221 of the water circuit 210. Furthermore, the hot-water storage tank 51 includes an immersion heater 60 provided therein. The immersion heater 60 is a heating unit which further heats the water in the hot-water storage tank 51.

An upper part of the interior of the hot-water storage tank 51 is connected to a sanitary circuit-side pipe 81*a*. The sanitary circuit-side pipe 81*a* is a hot-water supply pipe through which the hot water in the hot-water storage tank 51 is supplied to, for example, a shower. A lower part of the interior of the hot-water storage tank 51 is connected to a sanitary circuit-side pipe 81*b*. The sanitary circuit-side pipe 81*b* is a supply water pipe through which running water is supplied into the hot-water storage tank 51. At a lower part of the hot-water storage tank 51, a drain outlet 63 is provided to drain the water in the hot-water storage tank 51. The hot-water storage tank 51 is covered by a heat insulating material (not illustrated) to prevent reduction of the temperature of the water in the hot-water storage tank 51, which would be caused by heat transfer to the outside of the hot-water storage tank 51. As the heat insulating material, for example, felt, Thinsulate (registered trademark), or vacuum insulation panel (VIP) is applied.

The branch circuit 222 forming part of the heating circuit is provided in the indoor unit 200. The branch circuit 222 includes a supply pipe 222*a* and a return pipe 222*b*. An upstream end of the supply pipe 222*a* is connected to the other outflow port of the three-way valve 55. A downstream end of the supply pipe 222*a* is connected to the heating apparatus 300 by a heating-circuit-side pipe 82*a*. An upstream end of the return pipe 222*b* is connected to the heating apparatus 300 by a heating-circuit-side pipe 82*b*. A downstream end of the return pipe 222*b* is connected to the joining part 230. The heating-circuit-side pipes 82*a* and 82*b* and the heating apparatus 300 are disposed in the indoor space and outside the indoor unit 200. The branch circuit 222 forms together with the heating-circuit-side pipes 82*a* and 82*b* and the heating apparatus 300, the heating circuit.

The heating-circuit-side pipe 82*a* is connected to a pressure relief valve 301. The pressure relief valve 301 is a protection device which prevents an excessive increase in the inner pressure of the water circuit 210, and has the same structure as or a similar structure to the structure of, for example, the pressure relief valve 70. If the inner pressure of the heating-circuit-side pipe 82*a* exceeds a set pressure, the pressure relief valve 301 is opened to discharge water in the heating-circuit-side pipe 82*a* to the outside of the heating-circuit-side pipe 82*a* from the pressure relief valve 301. The pressure relief valve 301 is provided in the indoor space and outside the indoor unit 200.

The heating apparatus 300, the heating-circuit-side pipes 82*a* and 82*b* and the pressure relief valve 301 in embodiment 1 are not part of the heat-pump hot-water supply heating apparatus 1000, but are equipment to be installed by a technician in the actual place in accordance with the circumstances of each of properties. For example, in existing equipment using a boiler as a heat source apparatus of the heating apparatus 300, there is a case where the heat source apparatus is updated, that is, it is replaced with the heat-pump hot-water supply heating apparatus 1000. In such a case, the heating apparatus 300, the heating-circuit-side pipes 82*a* and 82*b*, and the pressure relief valve 301 continue to be used, unless they cause any particular inconvenience. Therefore, it is preferable that the heat-pump hot-water supply heating apparatus 1000 be connectable to variable kinds of equipment regardless of whether the pressure relief valve 301 is provided or not.

The indoor unit 200 is provided with the controller 201 which exerts control mainly of the operation of the water circuit 210 which includes the pump 53, the booster heater 54, the three-way valve 55, etc. The controller 201 includes a microcomputer provided with a CPU, a ROM, a RAM, an I/O port, etc. The controller 201 can mutually communicate with the controller 101 and the operation unit 202.

The operation unit 202 is configured to allow a user to operate the heat-pump hot-water supply heating apparatus 1000, and to make various settings. In embodiment 1, the operation unit 202 includes a display unit 203 as a notifying unit which indicates information. The display unit 203 displays various information such as the state of the heat-pump hot-water supply heating apparatus 1000. The operation unit 202 is attached to, for example, a surface of a housing of the indoor unit 200.

Next, it will be described what operation is performed if the partition wall isolating the refrigerant passage and the water passage from each other is broken in the load-side heat exchanger 2. The load-side heat exchanger 2 functions as an evaporator in the defrosting operation. Therefore, the partition wall of the load-side heat exchanger 2 may be broken by, for example, freezing of water which occurs particularly in the defrosting operation. In general, the pressure of refrigerant flowing in the refrigerant passage of the load-side heat exchanger 2 is higher than the pressure of water flowing in the water passage of the load-side heat exchanger 2 in either the normal operation or the defrosting operation. Therefore, if the partition wall of the load-side heat exchanger 2 is broken, the refrigerant in the refrigerant passage flows out into the water passage and mixes with the water in the water passage in either the normal operation or the defrosting operation. At this time, the pressure of the refrigerant mixing with the water is reduced, and the refrigerant thus gasifies. Further, since the refrigerant the pressure of which is higher than that of the water mixes into the water, the inner pressure of the water circuit 210 is raised.

The refrigerant mixing with the water of the water circuit 210 in the load-side heat exchanger 2 flows not only in a direction from the load-side heat exchanger 2 toward the booster heater 54, but in a direction from the load-side heat exchanger 2 toward the joining part 230, which is opposite to the direction of a normal flow of water, because of the difference in pressure between the refrigerant and water. Since the main circuit 220 of the water circuit 210 is provided with the pressure relief valve 70, the refrigerant mixing with the water may be discharged together with the water into the indoor space from the pressure relief valve 70. Further, in the case where the heating-circuit-side pipe 82*a* or 82*b* is provided with the pressure relief valve 301 as in embodiment 1, the refrigerant mixing with the water may be discharged together with the water into the indoor space from the pressure relief valve 301. That is, the pressure relief valves 70 and 301 both function as valves from which the refrigerant mixing with the water in the water circuit 210 is discharged to the outside of the water circuit 210. If the refrigerant is flammable, when the refrigerant is discharged from the pressure relief valve 70 or 301 into the indoor space, there is a risk that a flammable concentration region will be provided in the indoor space.

Figure 4:
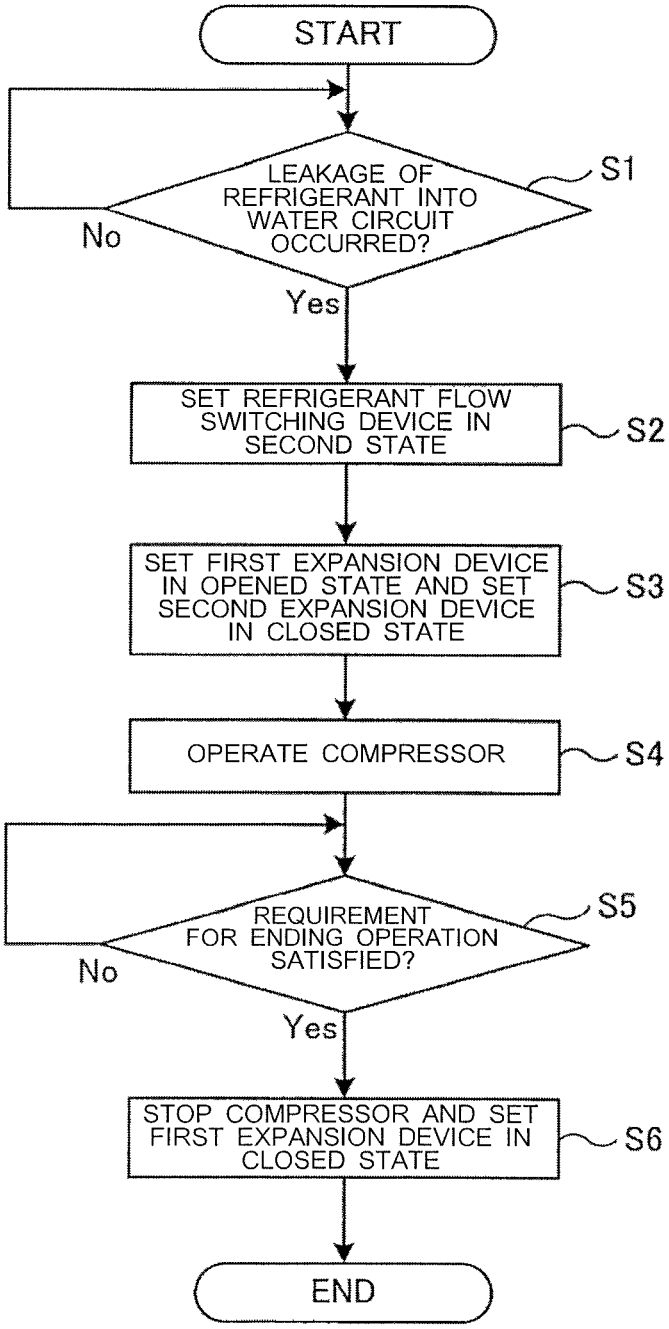
FIG. 4 is a flowchart illustrating an example of processes to be executed by a controller 101 of the heat-pump using apparatus according to embodiment 1 of the present invention.

In embodiment 1, if leakage of the refrigerant into the water circuit 210 is detected, a so-called pump-down operation is performed. FIG. 4 is a flowchart illustrating an example of processes to be executed by the controller 101 of the heat-pump using apparatus according to embodiment 1. The processes as illustrated in FIG. 4 are repeatedly executed at intervals of a predetermined time at all times, which include the time when the refrigerant circuit 110 is in the normal operation, the time when the refrigerant circuit 110 is in the defrosting operation, and the time when the refrigerant circuit 110 is in the stopped state.

At step S1 in FIG. 4, the controller 101 determines whether leakage of the refrigerant into the water circuit 210 occurs or not, based on a detection signal output from the refrigerant leakage detecting device 98 to the controller 101. If the controller 101 determines that the leakage of the refrigerant into the water circuit 210 occurs, the process to be executed proceeds to step S2.

At step S2, the controller 101 sets the refrigerant flow switching device 4 in the second state (that is, the state thereof in the defrosting operation or the cooling operation). To be more specific, when the refrigerant flow switching device 4 is in the first state, the controller 101 switches the state of the refrigerant flow switching device 4 from the first state to the second state. When the refrigerant flow switching device 4 is in the second state, the controller 101 keeps the refrigerant flow switching device 4 in the second state.

At step S3, the controller 101 sets the first expansion device 6 in the opened state. To be more specific, when the first expansion device 6 is in the opened state, the controller 101 keeps the first expansion device 6 in the opened state. By contrast, when the first expansion device 6 is in the closed state, the controller 101 switches the state of the first expansion device 6 from the closed state to the opened state. In this process, the opening degree of the first expansion device 6 may be set to the maximum opening degree. Furthermore, the controller 101 sets the second expansion device 7 in the closed state (for example, a fully closed state or a minimum opening-degree state). To be more specific, when the second expansion device 7 is in the opened state, the controller 101 switches the state of the second expansion device 7 from the opened state to the closed state. When the second expansion device 7 is in the closed state, the controller 101 keeps the second expansion device 7 in the closed state.

At step S4, the controller 101 operates the compressor 3. To be more specific, when the compressor 3 is in the stopped state, the controller 101 starts the operation of the compressor 3. When the compressor 3 is in operation, the controller 101 keeps the compressor 3 in operation. Thereby, the refrigerant in the refrigerant circuit 110 flows in the same direction as in the defrosting operation or the cooling operation. At step S4, the controller 101 may start measurement of a continuous operation time or an accumulated operation time of the compressor 3.

By executing the processes of steps S2, S3, and S4, the pump-down operation of the refrigerant circuit 110 is performed. Since the second expansion device 7, which is located downstream of the intermediate-pressure receiver 5, is closed, the refrigerant in the refrigerant circuit 110 is retrieved into the heat-source-side heat exchanger 1 and the intermediate-pressure receiver 5. To promote condensation and liquefaction of the refrigerant in the heat-source-side heat exchanger 1, the controller 101 may operate the outdoor fan 8. In this case, the liquid refrigerant condensed by the heat-source-side heat exchanger 1 is stored in the intermediate-pressure receiver 5 located downstream of the heat-source-side heat exchanger 1. Thereby, the heat-source-side heat exchanger 1 stores the refrigerant, with the refrigerant being in a gas-rich state, and the intermediate-pressure receiver 5 stores the refrigerant, with the refrigerant being in a liquid-rich state. It is therefore possible to store a larger amount of refrigerant in the intermediate-pressure receiver 5. Furthermore, to promote condensation and liquefaction of the refrigerant in the intermediate-pressure receiver 5, a cooling device which cools the intermediate-pressure receiver 5 may be provided. The intermediate-pressure receiver 5 of embodiment 1 includes an internal heat exchanger functioning as a cooling device. For example, a fan which sends air to the intermediate-pressure receiver 5 may be used as a cooling device other than the internal heat exchanger.

The execution order of steps S2, S3, and S4 is changeable. Furthermore, in the case where the refrigerant circuit 110 is a circuit dedicated to cooling and not including the refrigerant flow switching device 4, the process of step S2 is unnecessary.

Normally, when the operation of the refrigerant circuit 110 is switched from the heating operation to the cooling operation or the defrosting operation, the compressor 3 is temporarily stopped to uniformize the inner pressure of the refrigerant circuit 110. After the inner pressure of the refrigerant circuit 110 is uniformized, the state of the refrigerant flow switching device 4 is switched from the first state to the second state, and the compressor 3 is restarted. However, in embodiment 1, if the leakage of the refrigerant into the water circuit 210 is detected during the heating operation, the state of the refrigerant flow switching device 4 is switched from the first state to the second state, with the compressor 3 kept in operation, without stopping the compressor 3. As a result, the refrigerant in the refrigerant circuit 110 can be retrieved early, and the amount of refrigerant leaking into the water circuit 210 can thus be reduced to a small amount.

During the pump-down operation, the controller 101 repeatedly determines whether a predetermined requirement for ending the operation of the compressor 3 is satisfied or not (step S5). When determining that the condition for ending the operation of the compressor 3 is satisfied, the controller 101 stops the compressor 3 and sets the first expansion device 6 in the closed state (step S6). Thereby, the first expansion device 6 and the second expansion device 7 which are located on both respective sides of the intermediate-pressure receiver 5 in the refrigerant circuit 110, with the intermediate-pressure receiver 5 interposed between the first expansion device 6 and the second expansion device 7, are both set in the closed state. Furthermore, in the case where the outdoor fan 8 is in operation, the controller 101 stops the outdoor fan 8. Upon execution of those processes, the retrieval of the refrigerant by the pump-down operation is ended. The retrieved refrigerant is stored mainly in the intermediate-pressure receiver 5. Since the first expansion device 6 and the second expansion device 7 disposed on the both sides of the intermediate-pressure receiver 5 are both set in the closed state, the refrigerant stored in the intermediate-pressure receiver 5 is confined in a section between the first expansion device 6 and the second expansion device 7. Particularly in the case where an electronic expansion valve having a high closing function is used as each of the first expansion device 6 and the second expansion device 7, it is possible to more reliably reduce the amount of leakage of the retrieved refrigerant into the water circuit 210.

When the controller 101 determines that the requirement for ending the operation of the compressor 3 is satisfied, it may close the opening and closing valve 77 and the opening and closing valve 78, which are the first blocking device and the second blocking device, respectively. In the case where the opening and closing valves 77 and 78 are manual valves, the user or a serviceman may close the opening and closing valves 77 and 78 after ending of the pump-down operation, based on information displayed on the display unit 203 or an operation procedure described in a manual. It is thereby possible to more reliably prevent the retrieved refrigerant from flowing out into the load-side heat exchanger 2.

In place of or in addition to the opening and closing valve 77, a check valve located at a position at which the refrigerant constantly flows in a fixed direction may be used as the first blocking device. For example, a check valve provided at the suction pipe 11*a* or the discharge pipe 11*b* between the refrigerant flow switching device 4 and the compressor 3 may be used as the first blocking device, or the discharge valve 39 provided at the compressor 3 may be used as the first blocking device. In the case where the check valve or the discharge valve 39 is used as the first blocking device, it is not necessary to control the first blocking device to be closed. If the first blocking device is provided, the refrigerant stored in the intermediate-pressure receiver 5 and the heat-source-side heat exchanger 1 is confined in a section between the second expansion device 7 and the first blocking device. Therefore, in this case, it is also possible to omit the process of setting the first expansion device 6 in the closed state at step S6.

The requirement for ending the operation of the compressor 3 will be described. The requirement for ending the operation of the compressor 3 is, for example, a requirement that the continuous operation time or the accumulated operation time of the compressor 3 reaches a threshold time. The continuous operation time of the compressor 3 is time in which the compressor 3 is continuously operated after execution of the process of step S4. The accumulated operation time of the compressor 3 is accumulated time in which the compressor 3 is operated after execution of the process of step S4. The threshold time is set for each of devices in accordance with the capacity of the heat-source-side heat exchanger 1, the length of the refrigerant pipes in the refrigerant circuit 110, which include the extension pipes 111 and 112, or the amount of refrigerant enclosed in the refrigerant circuit 110, or the like.

The requirement for ending the operation of the compressor 3 may be set as a requirement that the inner pressure of the water circuit 210 falls below a first threshold pressure or tends to lower. In the case where the inner pressure of the water circuit 210 satisfies one of these requirements, it can be determined that leakage of the refrigerant into the water circuit 210 is reduced by retrieval of refrigerant which is effected by the pump-down operation.

The requirement for ending the operation of the compressor 3 may be set as a requirement that the pressure on a low-pressure side of the refrigerant circuit 110 falls below a threshold pressure. In this case, a pressure sensor or a low-pressure switch which detects the pressure on the low-pressure side of the refrigerant circuit 110 is provided at part of the refrigerant circuit 110 at which the pressure is reduced to a low level during the pump-down operation. The low-pressure switch may employ an electric system or a mechanical system using a diaphragm. When the refrigerant is retrieved, the pressure on the low-pressure side of the refrigerant circuit 110 is reduced to a low level. It is therefore possible to determine that the refrigerant is sufficiently retrieved, when the pressure on the low-pressure side of the refrigerant circuit 110 falls below the threshold pressure. In an air-conditioning apparatus, when the inner pressure of a refrigerant circuit falls below atmospheric pressure, there is a possibility that air will be sucked into the refrigerant circuit. By contrast, in embodiment 1, even if the inner pressure of the refrigerant circuit 110 falls below atmospheric pressure, the refrigerant circuit 110 merely sucks water in the water circuit 210, and hardly suck air. Therefore, the above threshold pressure may be set to a pressure lower than atmospheric pressure.

The requirement for ending the operation of the compressor 3 may be set as a requirement that a high-pressure-side pressure of the refrigerant circuit 110 exceeds a threshold pressure thereof. In this case, a pressure sensor or high-pressure switch which detects the pressure on the high-pressure side of the refrigerant circuit 110 is provided at part of the refrigerant circuit 110 at which the pressure is increased during the pump-down operation. The high-pressure switch may employ an electric system or a mechanical system using a diaphragm. When the refrigerant is retrieved, the pressure on the high-pressure side of the refrigerant circuit 110 is increased. It is therefore possible to determine that the refrigerant is sufficiently retrieved, when the pressure on the high-pressure side of the refrigerant circuit 110 exceeds the threshold pressure.

If the inner pressure of the water circuit 210 exceeds a second threshold pressure or tends to raise after ending of the pump-down operation of the refrigerant circuit 110, the compressor 3 and the outdoor fan 8 may be re-operated, and the pump-down operation of the refrigerant circuit 110 may be resumed. In the first expansion device 6, the second expansion device 7, the opening and closing valves 77 and 78 and the discharge valve 39, a foreign substance caught therein may cause slight leakage of refrigerant. Consequently, the retrieved refrigerant may leak into the water circuit 210 via the load-side heat exchanger 2. Therefore, in order to reduce leakage of refrigerant, it is effective that even after the pump-down operation is once ended, the pump-down operation is resumed based on the pressure in the water circuit 210. For example, the second threshold pressure is set to be higher than the first threshold pressure.

The refrigerant may be confined in the section between the second expansion device 7 and the first blocking device without retrieving the refrigerant through the pump-down operation. In this case, when the leakage of the refrigerant into the water circuit 210 is detected, the controller 101 stops the compressor 3, and sets the second expansion device 7 in the closed state. At this time, the controller 101 may set the first expansion device 6 in the closed state. Further, in this process, the controller 101 may set the refrigerant flow switching device 4 in the second state. In this case also, it is possible to reduce the amount of refrigerant leaking into the water circuit 210, and thus prevent leakage of the refrigerant into the indoor space.

Figure 5:
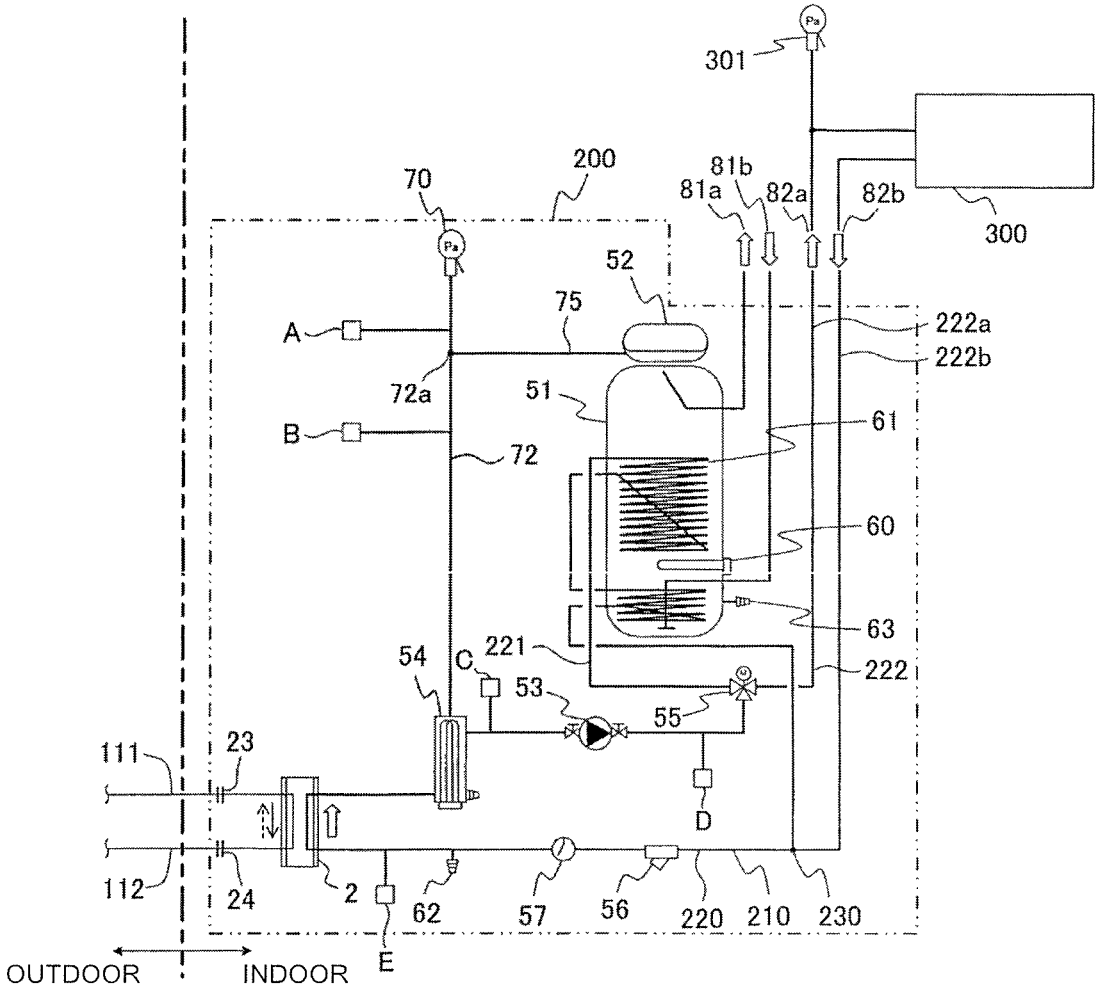
FIG. 5 is an explanatory diagram illustrating examples of the position of a refrigerant leakage detecting device 98 provided in the heat-pump using apparatus according to embodiment 1 of the present invention.

The position of the refrigerant leakage detecting device 98 provided will be described. FIG. 5 is an explanatory diagram illustrating examples of the position of the refrigerant leakage detecting device 98 in the heat-pump using apparatus according to embodiment 1. FIG. 5 illustrates five positions A to E as examples of the position of the refrigerant leakage detecting device 98. In the case where the refrigerant leakage detecting device 98 is provided at the position A or B, it is connected to the pipe 72. that is, it is connected to the main circuit 220 by the booster heater 54, as well as the pressure relief valve 70. In such a case, the refrigerant leakage detecting device 98 can reliably detect leakage of the refrigerant before the refrigerant leaking into the water circuit 210 in the load-side heat exchanger 2 is discharged from the pressure relief valve 70. When the leakage of the refrigerant into the water circuit 210 is detected by the refrigerant leakage detecting device 98, the pump-down operation of the refrigerant circuit 110 is immediately started to retrieve the refrigerant. It is therefore possible to minimize the amount of refrigerant leaking into the indoor space from the pressure relief valve 70. The same advantage as described above or a similar advantage to the advantage as described above can be also obtained in the case where the refrigerant leakage detecting device 98 is connected to the load-side heat exchanger 2 or between the load-side heat exchanger 2 and the booster heater 54 in the main circuit 220, as illustrated in FIG. 1.

In the case where the refrigerant leakage detecting device 98 is provided at the position C or D, it is connected between the booster heater 54 and the three-way valve 55 in the main circuit 220. In this case, the refrigerant may be discharged from the pressure relief valve 70 before the refrigerant leakage detecting device 98 detects the leakage of the refrigerant. However, when the leakage of the refrigerant into the water circuit 210 is detected, the pump-down operation of the refrigerant circuit 110 is immediately started, as described above, and the refrigerant is retrieved. It is therefore possible to prevent a large amount of refrigerant from leaking into the indoor space from the pressure relief valve 70.

In the case where the refrigerant leakage detecting device 98 is provided at the position E, it is connected between the load-side heat exchanger 2 and the joining part 230 in the main circuit 220. In this case, the refrigerant leakage detecting device 98 can reliably detect leakage of the refrigerant before the refrigerant leaking into the water circuit 210 is discharged from the pressure relief valve 301 provided outside the indoor unit 200. When the leakage of the refrigerant into the water circuit 210 is detected by the refrigerant leakage detecting device 98, the pump-down operation of the refrigerant circuit 110 is immediately started to retrieve the refrigerant. Therefore, it is possible to minimize the amount of refrigerant leaking into the indoor space from the pressure relief valve 301.

In all the configurations as illustrated in FIGS. 1 and 5, the refrigerant leakage detecting device 98 is connected to the main circuit 220, not to a branch circuit (for example, the heating-circuit-side pipes 82*a* and 82*b* and the heating apparatus 300) installed by a technician in the actual place. Thus, attachment of the refrigerant leakage detecting device 98 and connection between the refrigerant leakage detecting device 98 and the controller 201 can be carried out by a manufacturer of the indoor unit 200. It is therefore possible to avoid human errors such as a failure to attach the refrigerant leakage detecting device 98 and a failure to connect the refrigerant leakage detecting device 98 to the controller 201.

Figure 6:
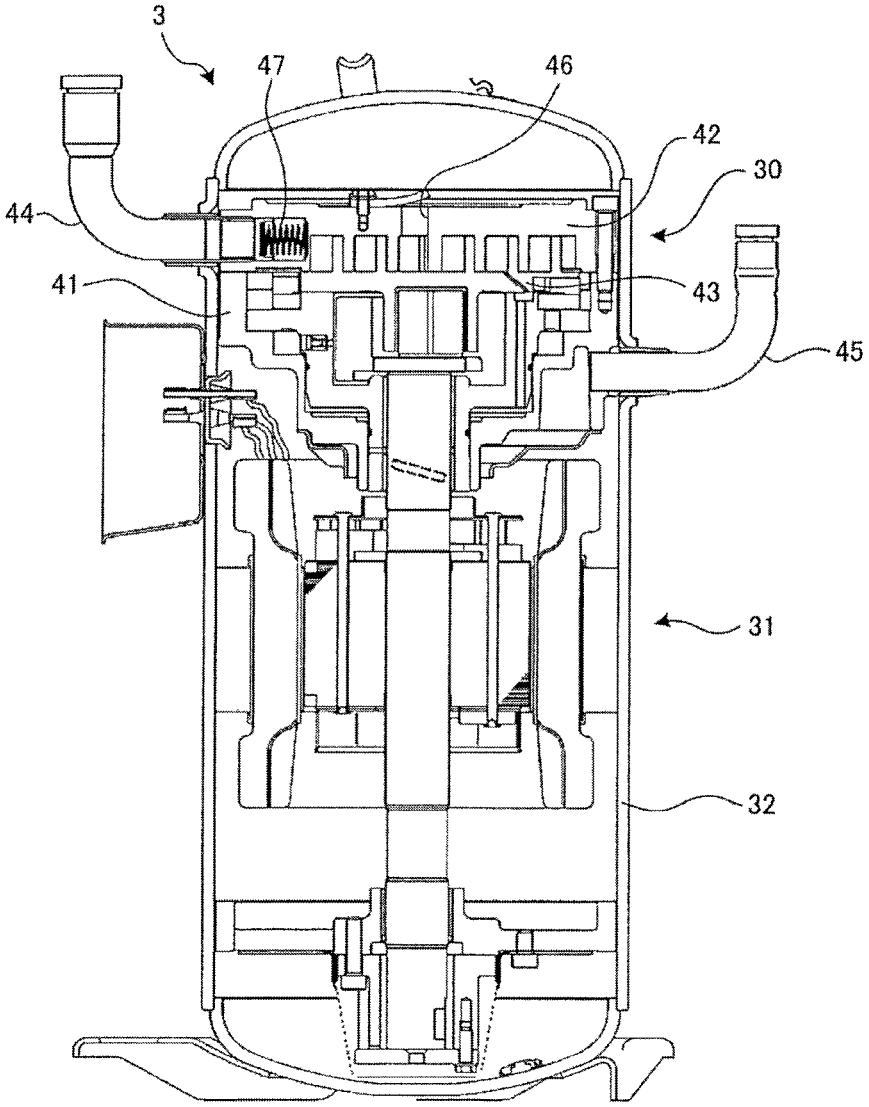
FIG. 6 is a sectional view illustrating a modified example of the configuration of the compressor 3 of the heat-pump using apparatus according to embodiment 1 of the present invention.

A modified example of the configuration of the compressor 3 will be described. FIG. 6 is a sectional view illustrating the modified example of the configuration of the compressor 3 of the heat-pump using apparatus according to embodiment 1. The compressor 3 of the modified example is a sealed and high-pressure shell type of scroll compressor. As illustrated in FIG. 6, the compressor 3 includes the compression mechanism unit 30 which sucks and compresses refrigerant, the electric motor unit 31 which drives the compression mechanism unit 30, and the sealed reservoir 32 which stores the compression mechanism unit 30 and the electric motor unit 31. The compression mechanism unit 30 is provided at upper part of the interior of the sealed reservoir 32. The electric motor unit 31 is located below the compression mechanism unit 30 in the sealed reservoir 32. The space in the sealed reservoir 32 is filled with high-pressure refrigerant compressed by the compression mechanism unit 30. The sealed reservoir 32 is connected to a suction pipe 44 through which low-pressure refrigerant is sucked and a discharge pipe 45 through which the high-pressure refrigerant is discharged.

The compression mechanism unit 30 includes a frame 41 fixed to the sealed reservoir 32, a fixed scroll 42 supported by the frame 41, and an orbiting scroll 43 which orbits the fixed scroll 42 by a rotational driving force of the electric motor unit 31 transmitted via the main shaft. Between a scroll tooth of the fixed scroll 42 and a scroll tooth of the orbiting scroll 43, there are provided a suction process compartment which communicates with the suction pipe 44, a compression process compartment for compressing the refrigerant sucked therein via a suction pipe 44, and a discharge process compartment which communicates with the space in the sealed reservoir 32 via a discharge hole 46. By driving of the orbiting scroll 43 by the electric motor unit 31, a suction process, a compression process and a discharge process are continuously repeated.

A check valve 47 is provided between the suction pipe 44 and the suction process compartment. The check valve 47 includes a valve body which opens and closes a suction passage for the refrigerant, and a spring which urges the valve body in a direction where it is closed, from a downstream side in the flow of the refrigerant. While the compressor 3 is in operation, a force acting on the valve body is increased to be greater than the urging force of the spring by the flow of the sucked refrigerant, thus causing the check valve 47 to be in the opened state. While the compressor 3 is in the stopped state, the check valve 47 is set in the closed state by the urging force of the spring. The check valve 47 has a function of preventing a reverse operation of the compression mechanism unit 30 and a backward flow of refrigerating machine oil, which would occur because of a pressure difference, when the compressor 3 is stopped. Normally, the pressure difference made when the compressor 3 is stopped is zeroed by opening the first expansion device 6 and the second expansion device 7. The scroll compressor may also include a discharge valve. In the modified example, the check valve 47 or the discharge valve included in the compressor 3 can be used as the first blocking device.

As described above, the heat-pump hot-water supply heating apparatus 1000 according to embodiment 1 includes: the refrigerant circuit 110 which includes the compressor 3, the refrigerant flow switching device 4, the heat-source-side heat exchanger 1, the first expansion device 6, the intermediate-pressure receiver 5, the second expansion device 7 and the load-side heat exchanger 2, and which circulates refrigerant; and the water circuit 210 which causes water to flow via the load-side heat exchanger 2. The state of the refrigerant flow switching device 4 is switched between the first state and the second state. When the state of the refrigerant flow switching device 4 is switched to the first state, the refrigerant circuit 110 can execute a first operation in which the load-side heat exchanger 2 functions as a condenser. When the state of the refrigerant flow switching device 4 is switched to the second state, the refrigerant circuit 110 can execute a second operation in which the load-side heat exchanger 2 functions as an evaporator. The first expansion device 6 is located downstream of the intermediate-pressure receiver 5 and upstream of the heat-source-side heat exchanger 1 in the flow of the refrigerant in the first operation. The second expansion device 7 is located downstream of the load-side heat exchanger 2 and upstream of the intermediate-pressure receiver 5 in the flow of the refrigerant in the first operation. The water circuit 210 includes the main circuit 220 which extends via the load-side heat exchanger 2. The main circuit 220 includes: the three-way valve 55 which is provided at the downstream end of the main circuit 220 and connected to the branch circuits 221 and 222 which branch off from the main circuit 220; and the joining part 23 which is provided at the upstream end of the main circuit 220 and connected to the branch circuits 221 and 222 which join the main circuit 220. The main circuit 220 is connected to the pressure relief valve 70 and the refrigerant leakage detecting device 98. The pressure relief valve 70 is connected to the connection part (the booster heater 54 in embodiment 1) which is located between the load-side heat exchanger 2 and one of the three-way valve 55 and the joining part 230 or at the load-side heat exchanger 2 in the main circuit 220. The refrigerant leakage detecting device 98 is connected to the other one of the three-way valve 55 and the joining part 230, between the other one of the three-way valve 55 and the joining part 230 and the booster heater 54, or to the booster heater 54 in the main circuit 220. When leakage of the refrigerant into the water circuit 210 is detected, the refrigerant flow switching device 4 is set in the second state, the first expansion device 6 is set in the opened state, the second expansion device 7 is set in the closed state, and the compressor 3 is operated.

It should be noted that the heat-pump hot-water supply heating apparatus 1000 is an example of the heat-pump using apparatus. The intermediate-pressure receiver 5 is an example of a reservoir. The water is an example of the heat medium. The water circuit 210 is an example of a heat medium circuit. The three-way valve 55 is an example of the branching part. The pressure relief valve 70 is an example of the overpressure protection device. The booster heater 54 is an example of the connection part.

In this configuration, in the case where the refrigerant leaks into the water circuit 210, the refrigerant leakage detecting device 98 can early detect the leakage of the refrigerant into the water circuit 210. When the leakage of the refrigerant into the water circuit 210 is detected, the refrigerant in the refrigerant circuit 110 is retrieved by the pump-down operation. Since the leakage of the refrigerant is early detected, the retrieval of the refrigerant is also early carried out. It is therefore possible to prevent or reduce leakage of the refrigerant into the indoor space.

Furthermore, the heat-pump hot-water supply heating apparatus 1000 according to embodiment 1 includes: the refrigerant circuit 110 which includes the compressor 3, the heat-source-side heat exchanger 1 functioning as a condenser, the first expansion device 6, the intermediate-pressure receiver 5, the second expansion device 7, and the load-side heat exchanger 2 functioning as an evaporator, and which circulates the refrigerant; and the water circuit 210 which causes the water to flow via the load-side heat exchanger 2. The first expansion device 6 is provided downstream of the heat-source-side heat exchanger 1 and upstream of the intermediate-pressure receiver 5 in the flow of the refrigerant. The second expansion device 7 is provided downstream of the intermediate-pressure receiver 5 and upstream of the load-side heat exchanger 2 in the flow of the refrigerant. The water circuit 210 includes the main circuit 220 which extends via the load-side heat exchanger 2. The main circuit 220 includes: the three-way valve 55 which is provided at the downstream end of the main circuit 220 and connected to those portions of the branch circuits 221 and 222 which branch off from the main circuit 220; and the joining part 230 which is provided at the upstream end of the main circuit 220 and connected to those portions of the branch circuits 221 and 222 which join the main circuit 220. The main circuit 220 is connected to the pressure relief valve 70 and the refrigerant leakage detecting device 98. The pressure relief valve 70 is connected to the connection part (the booster heater 54 in embodiment 1) which is located between the load-side heat exchanger 2 and one of the three-way valve 55 and the joining part 230 or at the load-side heat exchanger 2 in the main circuit 220. The refrigerant leakage detecting device 98 is connected to the other one of the three-way valve 55 and the joining part 230, between the other one of the three-way valve 55 and the joining part 230 and the booster heater 54, or to the booster heater 54 in the main circuit 220. When leakage of the refrigerant into the water circuit 210 is detected, the first expansion device 6 is set in the opened state, the second expansion device 7 is set in the closed state, and the compressor 3 is operated. It should be noted that the heat-pump hot-water supply heating apparatus 1000 is an example of the heat-pump using apparatus. The intermediate-pressure receiver 5 is an example of the reservoir. The water is an example of the heat medium. The water circuit 210 is an example of the heat medium circuit. The three-way valve 55 is an example of the branching part. The pressure relief valve 70 is an example of the overpressure protection device. The booster heater 54 is an example of the connection part.

In this configuration, in the case where the refrigerant leaks into the water circuit 210, the refrigerant leakage detecting device 98 can early detect the leakage of the refrigerant into the water circuit 210. When the leakage of the refrigerant into the water circuit 210 is detected, the refrigerant in the refrigerant circuit 110 is retrieved by the pump-down operation. Since the leakage of the refrigerant is early detected, the retrieval of the refrigerant is also early carried out. It is therefore possible to prevent or reduce leakage of the refrigerant into the indoor space.

The heat-pump hot-water supply heating apparatus 1000 according to embodiment 1 may be configured such that when the requirement for ending the operation is satisfied after the leakage of the refrigerant into the water circuit 210 is detected, the compressor 3 being in operation is stopped, and the first expansion device 6 and the second expansion device 7 are both set in the closed state. In this configuration, the first expansion device 6 and the second expansion device 7 disposed on the both sides of the intermediate-pressure receiver 5 are both set in the closed state. Therefore, the refrigerant stored in the intermediate-pressure receiver 5 by the pump-down operation is confined in the section between the first expansion device 6 and the second expansion device 7. It is therefore possible to prevent or reduce leakage of the recovered refrigerant into the indoor space.

In the heat-pump hot-water supply heating apparatus 1000 according to embodiment 1, the requirement for ending the operation may be set as a requirement in which the inner pressure of the water circuit 210 falls below the first threshold pressure or tends to lower. In this configuration, it is possible to end the pump-down operation at an appropriate time.

Embodiment 2

A heat-pump using apparatus according to embodiment 2 of the present invention will be described. The heat-pump using apparatus according to embodiment 2 is different from that according to embodiment 1 in the procedure of the pump-down operation. The circuit configuration of the heat-pump using apparatus according to embodiment 2 is the same as or similar to the circuit configuration of the heat-pump using apparatus according to embodiment 1 as illustrated in FIG. 1, and its illustration and description will be omitted.

Figure 7:
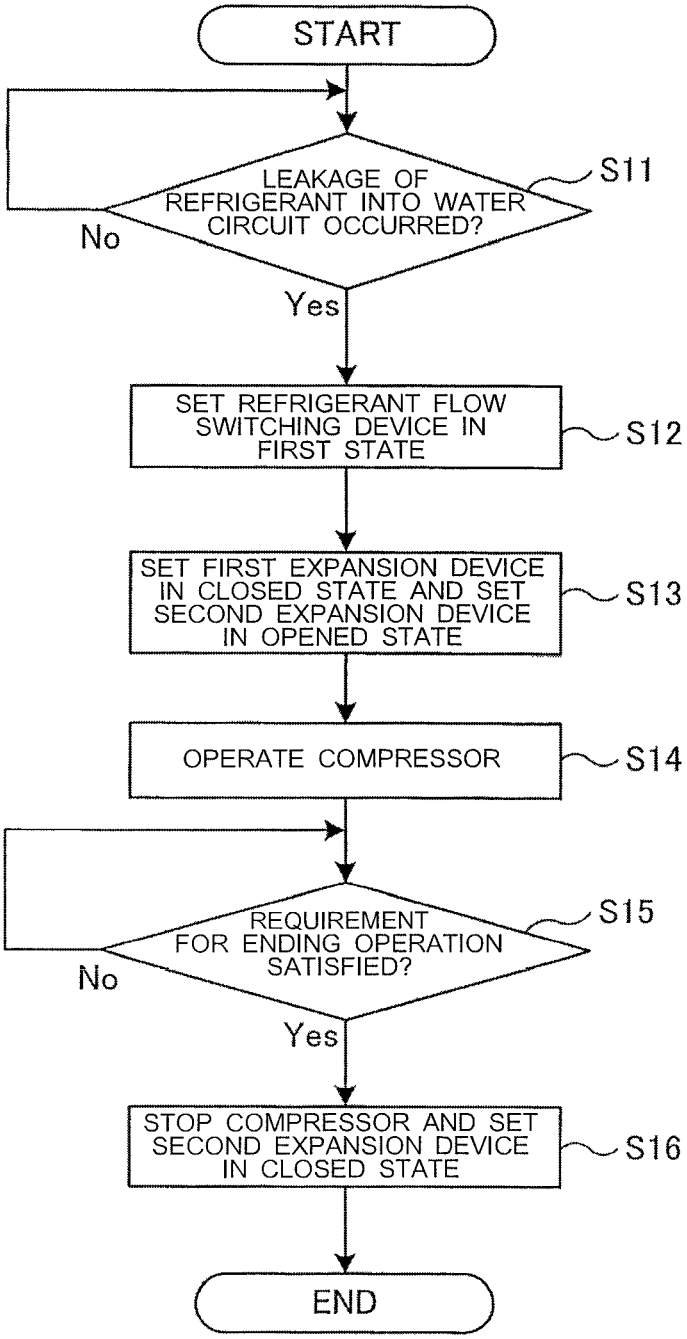
FIG. 7 is a flowchart illustrating an example of processes to be executed by the controller 101 of a heat-pump using apparatus according to embodiment 2 of the present invention.

FIG. 7 is a flowchart illustrating an example of processes to be executed by the controller 101 of the heat-pump using apparatus according to embodiment 2. The processes as indicated in FIG. 7 are repeatedly executed at intervals of predetermined time at all times which include time in which the refrigerant circuit 110 performs normal operation, time in which the refrigerant circuit 110 performs the defrosting operation, and time in which the refrigerant circuit 110 is in stopped state.

At step S11 in FIG. 7, based on a detection signal output to the controller 201 from the refrigerant leakage detecting device 98, the controller 101 determines whether the leakage of the refrigerant into the water circuit 210 occurs or not. In the case where it determines that the leakage of the refrigerant into the water circuit 210 occurs, the process to be executed proceeds to step S12.

At step S12, the controller 101 sets the refrigerant flow switching device 4 in the first state (that is, the state thereof in the normal operation). To be more specific, when the refrigerant flow switching device 4 is in the second state, the controller 101 switches the state of the refrigerant flow switching device 4 from the second state to the first state. When the refrigerant flow switching device 4 is in the first state, the controller 101 keeps the refrigerant flow switching device 4 in the first state.

At step S13, the controller 101 sets the first expansion device 6 in the closed state (for example, the fully closed state or the minimum opening degree state). To be more specific, when the first expansion device 6 is in the opened state, the controller 101 switches the state of the first expansion device 6 from the opened state to the closed state. When the first expansion device 6 is in the closed state, the controller 101 keeps the first expansion device 6 in the closed state. Further, the controller 101 sets the second expansion device 7 in the opened state. To be more specific, when the second expansion device 7 is in the opened state, the controller 101 keeps the second expansion device 7 in the opened state. When the second expansion device 7 is in the closed state, the controller 101 switches the state of the second expansion device 7 from the closed state to the opened state. In this process, the opening degree of the second expansion device 7 may be set to the maximum opening degree.

At step S14, the controller 101 operates the compressor 3. To be more specific, when the compressor 3 is in the stopped state, the controller 101 starts the operation of the compressor 3. When the compressor 3 is in operation, the controller 101 keeps the compressor 3 in operation. Thereby, the refrigerant in the refrigerant circuit 110 flows in the same direction as in the normal operation. At step S14, the controller 101 may start measurement of the continuous operation time or the accumulated operation time of the compressor 3.

By the execution of the processes of steps S12, S13, and S14, the pump-down operation of the refrigerant circuit 110 is performed. Since the first expansion device 6 located downstream of the intermediate-pressure receiver 5 is closed, the refrigerant in the refrigerant circuit 110 is retrieved into the intermediate-pressure receiver 5. To promote condensation and liquefaction of the refrigerant in the intermediate-pressure receiver 5, a cooling device for cooling the intermediate-pressure receiver 5 may be provided. The intermediate-pressure receiver 5 of embodiment 2 includes an internal heat exchanger functioning as the cooling device. A device such as a fan which sends air to the intermediate-pressure receiver 5 may be used as a cooling device other than the internal heat exchanger. In the case where the cooling device which cools the intermediate-pressure receiver 5 is provided, the operation of the cooling device may be started at one of steps S12, S13, and S14. By operating the cooling device, the condensation and liquefaction of the refrigerant in the intermediate-pressure receiver 5 is promoted. As a result, the refrigerant, which is made in a liquid rich state, is stored in the intermediate-pressure receiver 5, and a larger amount of refrigerant can thus be stored in the intermediate-pressure receiver 5. In this process, in embodiment 2, it is not necessary to operate the outdoor fan 8.

The execution order of steps S12, S13, and S14 is changeable.

In embodiment 1, in the case where the pump-down operation is performed, the refrigerant flow switching device 4 is set in the second state. If the leakage of the refrigerant is detected, with the refrigerant flow switching device 4 set in the first state (during the normal operation, for example), an extra time is required, that is, it is necessary to switch the refrigerant flow switching device 4 from the first state to the second state before retrieval of the refrigerant by the pump-down operation starts. By contrast, in embodiment 2, in the case where the pump-down operation is performed, the refrigerant flow switching device 4 is set in the first state. Thus, even if leakage of the refrigerant is detected, with the refrigerant flow switching device 4 set in the first state, it is possible to start retrieval of the refrigerant by the pump-down operation.

During the pump-down operation, the controller 101 repeatedly determines whether the previously set requirement for ending the operation of the compressor 3 is satisfied or not (step S15). If the controller 101 determines which the requirement for ending the operation of the compressor 3 is satisfied, it stops the compressor 3, and sets the second expansion device 7 in the closed state (step S16). Thereby, the first expansion device 6 and the second expansion device 7 disposed on the both sides of the intermediate-pressure receiver 5 in the refrigerant circuit 110 are both set in the closed state. Consequently, the retrieval of the refrigerant by the pump-down operation is ended. The retrieved refrigerant is stored mainly in the intermediate-pressure receiver 5. Since the first expansion device 6 and the second expansion device 7 disposed on the both sides of the intermediate-pressure receiver 5 are both set in the closed state, the refrigerant stored in the intermediate-pressure receiver 5 is confined in the section between the first expansion device 6 and the second expansion device 7.

In embodiment 2, when leakage of the refrigerant into the water circuit 210 is detected, the controller 101 may first determine whether the refrigerant flow switching device 4 is in the first state or the second state. If the controller 101 determines that the refrigerant flow switching device 4 is in the first state, it performs the processes of steps S13 to S16. Further, if the controller 101 determines which the refrigerant flow switching device 4 is in the second state, it performs the processes of steps S3 to S6 indicated in FIG. 4 in place of the processes of steps S13 to S16. It is therefore possible to early start the retrieval of the refrigerant by the pump-down operation, regardless of whether the refrigerant flow switching device 4 is in the first state or the second state when the leakage of the refrigerant into the water circuit 210 is detected.

As described above, the heat-pump hot-water supply heating apparatus 1000 according to embodiment 2 includes: the refrigerant circuit 110 which includes the compressor 3, the refrigerant flow switching device 4, the heat-source-side heat exchanger 1, the first expansion device 6, the intermediate-pressure receiver 5, the second expansion device 7 and the load-side heat exchanger 2, and which circulates the refrigerant; and the water circuit 210 which causes the water to flow via the load-side heat exchanger 2. The refrigerant flow switching device 4 is configured such that its state is switched between the first state and the second state. When the state of the refrigerant flow switching device 4 is switched to the first state, the refrigerant circuit 110 can execute the first operation in which the load-side heat exchanger 2 functions as a condenser. When the state of the refrigerant flow switching device 4 is switched to the second state, the refrigerant circuit 110 can execute the second operation in which the load-side heat exchanger 2 functions as an evaporator. The first expansion device 6 is located downstream of the intermediate-pressure receiver 5 and upstream of the heat-source-side heat exchanger 1 in the flow of the refrigerant in the first operation. The second expansion device 7 is located downstream of the load-side heat exchanger 2 and upstream of the intermediate-pressure receiver 5 in the flow of the refrigerant in the first operation. The water circuit 210 includes the main circuit 220 which extends via the load-side heat exchanger 2. The main circuit 220 includes: the three-way valve 55 which is provided at the downstream end of the main circuit 220 and connected to those portions of the plurality of branch circuits 221 and 222 which branch off from the main circuit 220, and the joining part 230 which is provided at the upstream end of the main circuit 220 and connected to those portions of the branch circuits 221 and 222 which join the main circuit 220. The main circuit 220 is connected to the pressure relief valve 70 and the refrigerant leakage detecting device 98. The pressure relief valve 70 is connected to the connection part (the booster heater 54 in embodiment 2) which is located between the load-side heat exchanger 2 and one of the three-way valve 55 and the joining part 230 or at the load-side heat exchanger 2 in the main circuit 220. The refrigerant leakage detecting device 98 is connected to the other one of the three-way valve 55 and the joining part 230, between the other one of the three-way valve 55 and the joining part 230 and the booster heater 54, or to the booster heater 54 in the main circuit 220. When leakage of the refrigerant into the water circuit 210 is detected, the refrigerant flow switching device 4 is set in the first state, the first expansion device 6 is set in the closed state, the second expansion device 7 is set in the open state, and the compressor 3 is operated.

It should be noted that the heat-pump hot-water supply heating apparatus 1000 is an example of the heat-pump using apparatus. The intermediate-pressure receiver 5 is an example of the reservoir. The water is an example of the heat medium. The water circuit 210 is an example of the heat medium circuit. The three-way valve 55 is an example of the branching part. The pressure relief valve 70 is an example of the overpressure protection device. The booster heater 54 is an example of the connection part.

In this configuration, if the refrigerant leaks into the water circuit 210, the refrigerant leakage detecting device 98 can early detect the leakage of the refrigerant into the water circuit 210. When the leakage of the refrigerant into the water circuit 210 is detected, the refrigerant in the refrigerant circuit 110 is retrieved by the pump-down operation. Since the leakage of the refrigerant is early detected, the retrieval of the refrigerant is also early performed. It is therefore possible to prevent or reduce the leakage of the refrigerant into the indoor space.

Furthermore, in this configuration, even if the leakage of the refrigerant is detected, with the refrigerant flow switching device 4 set in the first state, it is possible to early start the retrieval of the refrigerant by the pump-down operation.

The heat-pump hot-water supply heating apparatus 1000 according to embodiment 2 may further include the cooling device which cools the intermediate-pressure receiver 5. In this configuration, the condensation and liquefaction of the refrigerant in the intermediate-pressure receiver 5 are promoted, and a larger amount of refrigerant can thus be stored in the intermediate-pressure receiver 5.

Embodiment 3

Figure 8:
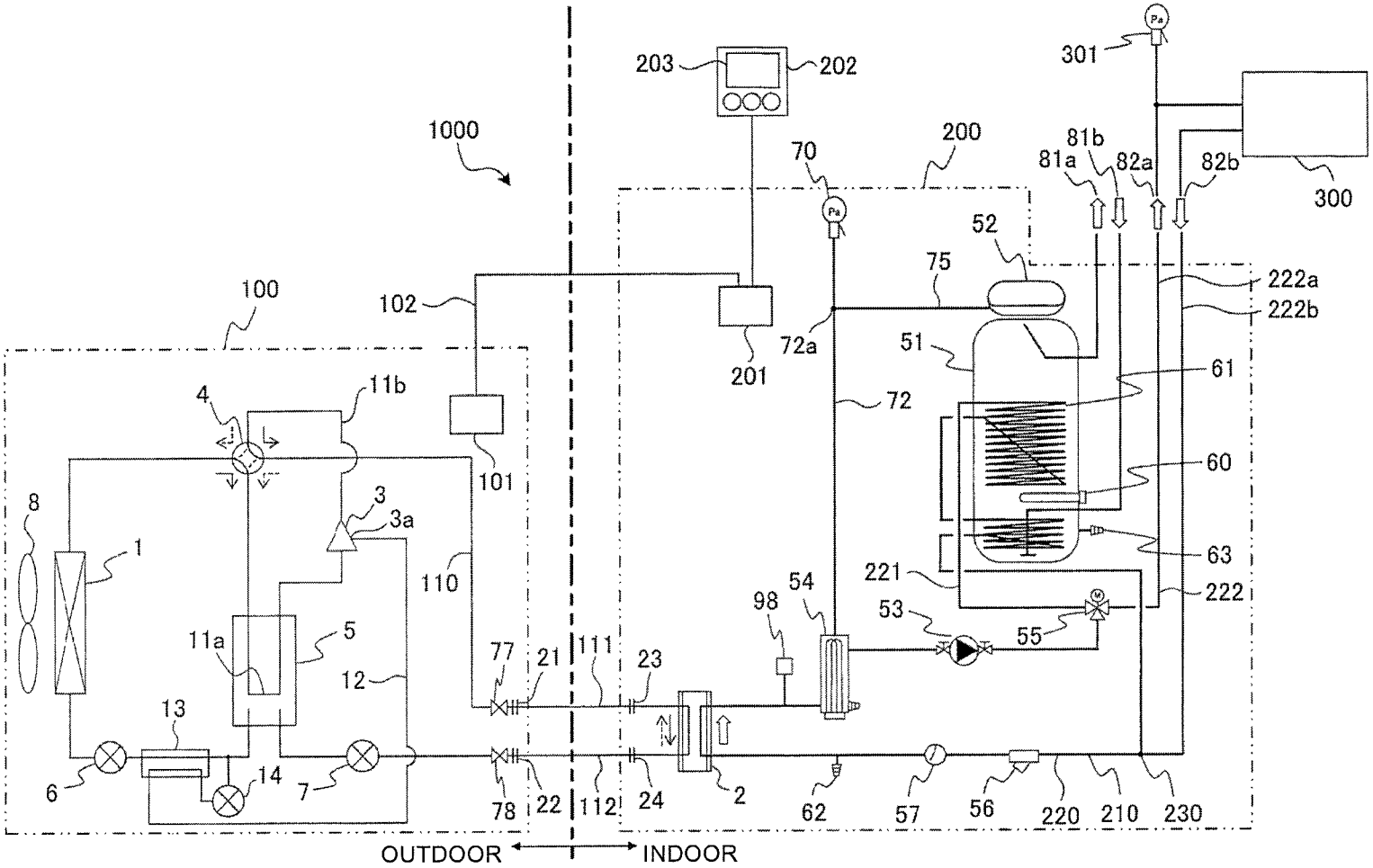
FIG. 8 is a circuit diagram illustrating a schematic configuration of a heat-pump using apparatus according to embodiment 3 of the present invention.

A heat-pump using apparatus according to embodiment 3 of the present invention will be described. The heat-pump using apparatus according to embodiment 3 is different from which according to embodiment 1 in the configuration of the refrigerant circuit 110. FIG. 8 is a circuit diagram illustrating a schematic configuration of the heat-pump using apparatus according to embodiment 3. In embodiment 3, the heat-pump hot-water supply heating apparatus 1000 is provided as an example of the heat-pump using apparatus. It should be noted that component elements having the same functions and advantages as those of embodiment 1 will be denoted by the same reference signs, and their descriptions will thus be omitted.

As illustrated in FIG. 8, the refrigerant circuit 110 of embodiment 3 includes a refrigeration cycle circuit which has the same configuration as or a similar configuration to that of the refrigerant circuit 110 of embodiment 1, and an intermediate-pressure injection circuit 12 which is provided to branch off from the refrigeration cycle circuit, and improve the heating capacity. The compressor 3 includes an injection port 3*a* which is formed to communicate with the compression compartment during the compression process. The intermediate-pressure injection circuit 12 branches off from the refrigeration cycle circuit at a location between the intermediate-pressure receiver 5 and the first expansion device 6, and is connected to the injection port 3*a* of the compressor 3. The intermediate-pressure injection circuit 12 includes a third expansion device 14 and an internal heat exchanger 13.

The third expansion device 14 is a valve which adjusts the flow rate of part of the refrigerant, which branches off therefrom to flow into the intermediate-pressure injection circuit 12, to thereby adjust the pressure of the part of the refrigerant. As the third expansion device 14, an electronic expansion valve, the opening degree of which is changed continuously or stepwise by the control by the controller 101, is used.

The internal heat exchanger 13 causes heat exchange to be performed between the refrigerant reduced in pressure by the third expansion device 14 and the refrigerant flowing through part of the refrigeration cycle circuit which is located between the intermediate-pressure receiver 5 and the first expansion device 6. For example, a double-pipe heat exchanger is used as the internal heat exchanger 13.

In the normal operation, part of the refrigerant flowing from the intermediate-pressure receiver 5 flows into the intermediate-pressure injection circuit 12. After the part of the refrigerant which has flowed into the intermediate-pressure injection circuit 12 is decompressed by the third expansion device 14, the part of the refrigerant is subjected to heat exchange in the internal heat exchanger 13, and the specific enthalpy of the part of the refrigerant is thus increased, whereby the part thereof changes into high-quality, two-phase refrigerant having an intermediate pressure higher than the suction pressure and lower than the discharge pressure. The high-quality, two-phase refrigerant is injected through the injection port 3*a* into the compression compartment of the compressor 3, in which the compression process is being executed.

In the heat-pump hot-water supply heating apparatus 1000 according to embodiment 3, when leakage of the refrigerant into the water circuit 210 is detected, for example, the processes of steps S2 to S6 illustrated in FIG. 4 are executed. However, at step S3, the third expansion device 14 is also set in the closed state as well as the second expansion device 7. With the execution of the processes of steps S2, S3, and S4, the refrigerant in the refrigerant circuit 110 is retrieved into the heat-source-side heat exchanger 1 and the intermediate-pressure receiver 5.

Furthermore, in the heat-pump hot-water supply heating apparatus 1000 of embodiment 3, when the leakage of the refrigerant into the water circuit 210 is detected, the processes of steps S12 to S16 as indicated in FIG. 7 may be performed. At step S13, however, the third expansion device 14 is also set in the closed state as well as the first expansion device 6. By the execution of the processes of steps S12, S13 and S14, the refrigerant in the refrigerant circuit 110 is retrieved into the intermediate-pressure receiver 5.

Furthermore, in the heat-pump hot-water supply heating apparatus 1000 of embodiment 3, when leakage of the refrigerant into the water circuit 210 is detected, the refrigerant may be confined in a section of the refrigerant circuit 110, which includes the intermediate-pressure receiver 5, without execution of the retrieval of the refrigerant by the pump-down operation. In this case, when the leakage of the refrigerant into the water circuit 210 is detected, the controller 101 stops the compressor 3, and sets the second expansion device 7 and the third expansion device 14 in the closed state. At this time, the controller 101 may set the first expansion device 6 in the closed state, and may also set the refrigerant flow switching device 4 in the second state.

As described above, in the heat-pump hot-water supply heating apparatus 1000 according to embodiment 3, the refrigerant circuit 110 includes the intermediate-pressure injection circuit 12 which branches off at a location between the first expansion device 6 and the intermediate-pressure receiver 5, and which is connected to the compressor 3. The intermediate-pressure injection circuit 12 includes the third expansion device 14. When the leakage of the refrigerant into the water circuit 210 is detected, the third expansion device 14 is also set in the closed state. It should be noted that the intermediate-pressure injection circuit 12 is an example of a branching circuit.

According to embodiment 3, advantages which are the same as or similar to those of embodiment 1 or 2 can be obtained.

The present invention is not limited to embodiments 1 to 3 described above, and may be modified in various ways.

For example, with respect to the above embodiments, although the plate heat exchanger is described above as an example of the load-side heat exchanger 2, a heat exchanger other than the plate heat exchanger, such as a double-pipe heat exchanger, may be provided as the load-side heat exchanger, as long as it causes heat exchange to be performed between the refrigerant and the heat medium.

Also, with respect to the above embodiments, although the heat-pump hot-water supply heating apparatus 1000 is described as an example of the heat-pump using apparatus, the present invention is also applicable to other heat-pump using apparatuses such as a chiller.

Furthermore, with respect to the above embodiments, although the indoor unit 200 including the hot-water storage tank 51 is described as an example, the hot-water storage tank may be provided separate from the indoor unit 200.

In addition, with respect to the above embodiments, although it is described as an example of a configuration that the load-side heat exchanger 2 is provided in the indoor unit, the load-side heat exchanger 2 may be provided in the outdoor unit 100. In the case where, the load-side heat exchanger 2 is provided in the outdoor unit 100, the entire refrigerant circuit 110 is provided in the outdoor unit 100, and in addition, the outdoor unit 100 and indoor unit 200 are connected via two water pipes which form part of the water circuit 210.

Embodiments 1 to 3 and the modified examples described above can be combined together when they are put to practical use.

REFERENCE SIGNS LIST

1 heat-source-side heat exchanger 2 load-side heat exchanger 3 compressor 3*a* injection port 4 refrigerant flow switching device 5 intermediate-pressure receiver 6 first expansion device 7 second expansion device 8 outdoor fan 11*a* suction pipe 11*b* discharge pipe 12 intermediate-pressure injection circuit 13 internal heat exchanger 14 third expansion device 21, 22, 23, 24 joint part 30 compression mechanism unit 31 electric motor unit 32 sealed reservoir 33 cylinder 34 rolling piston 35 upper end plate 36 lower end plate 37 suction pipe 38 discharge hole 39 discharge valve 40 valve stopper 41 frame 42 fixed scroll 43 orbiting scroll 44 suction pipe 45 discharge pipe 46 discharge hole 47 check valve 51 hot-water storage tank 52 expansion tank 53 pump 54 booster heater 55 three-way valve 56 strainer 57 flow switch 60 immersion heater 61 coil 62, 63 drain outlet 70 pressure relief valve 72 pipe 72*a* branching part 75 pipe 77, 78 opening and closing valve 81*a*, 81*b* sanitary circuit-side pipe 82*a*, 82*b* heating-circuit-side pipe 98 refrigerant leakage detecting device 100 outdoor unit 101 controller 102 control line 110 refrigerant circuit 111, 112 extension pipe 200 indoor unit 201 controller 202 operation unit 203 display unit 210 water circuit 220 main circuit 221, 222 branch circuit 222*a* supply pipe 222*b* return pipe 230 joining part 300 heating apparatus 301 pressure relief valve 1000 heat-pump hot-water supply heating apparatus

The invention claimed is:

1. A heat-pump apparatus comprising:

a controller;

a refrigerant circuit including a compressor, a refrigerant flow switching valve, a heat-source-side heat exchanger, a first expansion valve, a reservoir, a second expansion valve and a load-side heat exchanger, the refrigerant circuit being configured to circulate refrigerant; and a heat medium circuit configured such that a heat medium flows via the load-side heat exchanger, a state of the refrigerant flow switching valve being switchable between a first state and a second state, the refrigerant circuit performs a first operation in which the load-side heat exchanger functions as a condenser, when the state of the refrigerant flow switching valve is switched to the first state, the refrigerant circuit performs a second operation in which the load-side heat exchanger functions as an evaporator, when the state of the refrigerant flow switching valve is switched to the second state, the first expansion valve being provided downstream of the reservoir and upstream of the heat-source-side heat exchanger in a flow of the refrigerant in the first operation, the second expansion valve being provided downstream of the load-side heat exchanger and upstream of the reservoir in the flow of the refrigerant in the first operation, the heat medium circuit including a main circuit extending via the load-side heat exchanger, the main circuit including a branching part located at a downstream end of the main circuit, and connected to a plurality of branch circuits, and a joining part located at an upstream end of the main circuit, and connected to the plurality of branch circuits, the main circuit being connected to a pressure relief valve and a refrigerant leakage detecting pressure sensor, the pressure relief valve being connected to a connection part which is located between the load-side heat exchanger and one of the branching part and the joining part in the main circuit or downstream of the load-side heat exchanger in the main circuit, the refrigerant leakage detecting pressure sensor being connected (a) to one of the branching part and the joining part in the main circuit, (b) between the branching part and the connection part in the main circuit, (c) between the joining part and the connection part in the main circuit or (d) to the connection part in the main circuit, and the controller is configured to, when leakage of the refrigerant into the heat medium circuit is detected, set the refrigerant flow switching valve in the second state, set the first expansion valve being set in an opened state, set the second expansion valve in a closed state, and set the compressor in operation.

2. A heat-pump apparatus comprising:

a controller;

a refrigerant circuit including a compressor, a refrigerant flow switching valve, a heat-source-side heat exchanger, a first expansion valve, a reservoir, a second expansion valve and a load-side heat exchanger, the refrigerant circuit being configured to circulate refrigerant; and a heat medium circuit configured such that a heat medium flows via the load-side heat exchanger, a state of the refrigerant flow switching valve being switchable between a first state and a second state, the refrigerant circuit performs a first operation in which the load-side heat exchanger functions as a condenser, when the state of the refrigerant flow switching valve is switched to the first state, the refrigerant circuit performs a second operation in which the load-side heat exchanger functions as an evaporator, when the state of the refrigerant flow switching is switched to the second state, the first expansion valve being provided downstream of the reservoir and upstream of the heat-source-side heat exchanger in a flow of the refrigerant in the first operation, the second expansion valve being provided downstream of the load-side heat exchanger and upstream of the reservoir in the flow of the refrigerant in the first operation, the heat medium circuit including a main circuit extending via the load-side heat exchanger, the main circuit including a branching part located at a downstream end of the main circuit, and connected to a plurality of branch circuits, and a joining part located at an upstream end of the main circuit, and connected to the plurality of branch circuits, the main circuit being connected to a pressure relief valve and a refrigerant leakage detecting pressure sensor, the pressure relief valve being connected to a connection part which is located between the load-side heat exchanger and one of the branching part and the joining part or downstream of the load-side heat exchanger in the main circuit, the refrigerant leakage detecting pressure sensor being connected (a) to one of the branching part and the joining part in the main circuit, (b) between the branching part and the connection part in the main circuit, (c) between the joining part and the connection part in the main circuit, or (d) to the connection part in the main circuit, and the controller is configured to, when leakage of the refrigerant into the heat medium circuit is detected, set the refrigerant flow switching valve in the first state, set the first expansion valve in a closed state, set the second expansion valve in an opened state, and set the compressor in operation.

3. The heat-pump apparatus of claim 1, wherein the refrigerant circuit includes a branching circuit which branches off therefrom at a location between the first expansion valve and the reservoir, and which is connected to the compressor, the branching circuit includes a third expansion valve, and the controller is further configured to, when leakage of the refrigerant into the heat medium circuit is detected, set the third expansion valve in a closed state.

4. A heat-pump apparatus comprising:

a controller;

a refrigerant circuit including a compressor, a heat-source-side heat exchanger functioning as a condenser, a first expansion valve, a reservoir, a second expansion valve and a load-side heat exchanger functioning as an evaporator, the refrigerant circuit being configured to circulate refrigerant; and a heat medium circuit configured such that a heat medium flows via the load-side heat exchanger, the first expansion valve being provided downstream of the heat-source-side heat exchanger and upstream of the reservoir in a flow of the refrigerant, the second expansion valve being provided downstream of the reservoir and upstream of the load-side heat exchanger in the flow of the refrigerant, the heat medium circuit including a main circuit extending via the load-side heat exchanger, the main circuit including a branching part located at a downstream end of the main circuit, and connected to a plurality of branch circuits and a joining part located at an upstream end of the main circuit, and connected to the plurality of branch circuits, the main circuit being connected to a pressure relief valve and a refrigerant leakage detecting pressure sensor, the pressure relief valve being connected to a connection part which is located between the load-side heat exchanger and one of the branching part and the joining part in the main circuit or downstream of the load-side heat exchanger in the main circuit, the refrigerant leakage detecting pressure sensor being connected (a) to one of the branching part and the joining part in the main circuit, (b) between the branching part and the connection part in the man circuit, (c) between the joining part and the connection part in the main circuit, or (d) to the connection part in the main circuit, and the controller is configured to, when leakage of the refrigerant into the heat medium circuit is detected, set the first expansion valve in an opened state, set the second expansion valve in a closed state, and set the compressor in operation.

5. The heat-pump apparatus of claim 1, further comprising a fan or internal heat exchanger configured to cool the reservoir.

6. The heat-pump apparatus of claim 1, wherein the controller is further configured to, when a requirement for ending an operation is satisfied after the leakage of the refrigerant into the heat medium circuit is detected, stop the compressor being in operation and set both the first expansion valve and the second expansion valve in the closed state.

7. The heat-pump apparatus of claim 6, wherein the requirement for ending the operation is a requirement that a pressure of the heat medium circuit falls below a threshold pressure.

8. The heat-pump apparatus of claim 2, wherein the refrigerant circuit includes a branching circuit which branches off therefrom at a location between the first expansion valve and the reservoir, and which is connected to the compressor, the branching circuit includes a third expansion valve, and the controller is further configured to, when leakage of the refrigerant into the heat medium circuit is detected, set the third expansion valve in a closed state.

9. The heat-pump apparatus of claim 2, further comprising a fan or internal heat exchanger configured to cool the reservoir.

10. The heat-pump apparatus of claim 4, further comprising a fan or internal heat exchanger configured to cool the reservoir.

11. The heat-pump apparatus of claim 2, wherein the controller is further configured to, when a requirement for ending an operation is satisfied after the leakage of the refrigerant into the heat medium circuit is detected, stop the compressor being in operation and set both the first expansion valve and the second expansion valve in the closed state.

12. The heat-pump apparatus of claim 4, wherein the controller is further configured to, when a requirement for ending an operation is satisfied after the leakage of the refrigerant into the heat medium circuit is detected, stop the compressor being in operation, and set both the first expansion valve and the second expansion valve in the closed state.

13. The heat-pump apparatus of claim 11, wherein the requirement for ending the operation is a requirement that a pressure of the heat medium circuit falls below a threshold pressure.

14. The heat-pump apparatus of claim 12, wherein the requirement for ending the operation is a requirement that a pressure of the heat medium circuit falls below a threshold pressure.

* * * * *